US009184541B2

(12) United States Patent
Miyamoto et al.

(10) Patent No.: US 9,184,541 B2
(45) Date of Patent: Nov. 10, 2015

(54) TERMINAL AND TERMINAL-PROVIDED WIRE

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Kenji Miyamoto, Mie (JP); Junichi Ono, Mie (JP); Toshiya Oota, Mie (JP); Takuji Otsuka, Mie (JP); Takashi Tonosaki, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/385,175

(22) PCT Filed: Mar. 15, 2013

(86) PCT No.: PCT/JP2013/057385

§ 371 (c)(1),
(2) Date: Sep. 15, 2014

(87) PCT Pub. No.: WO2013/137429

PCT Pub. Date: Sep. 19, 2013

(65) Prior Publication Data

US 2015/0079825 A1 Mar. 19, 2015

(30) Foreign Application Priority Data

Mar. 15, 2012 (JP) ..... 2012-058869
Mar. 28, 2012 (JP) ..... 2012-075107

(51) Int. Cl.
*H01R 4/10* (2006.01)
*H01R 13/633* (2006.01)
(Continued)

(52) U.S. Cl.
CPC ..... *H01R 13/633* (2013.01); *H01R 4/20* (2013.01); *H01R 4/206* (2013.01); *H01R 4/62* (2013.01); *H01R 4/185* (2013.01)

(58) Field of Classification Search
CPC ..... H01R 4/185; H01R 4/188; H01R 4/2495
USPC ..... 439/877, 882, 442, 421, 423, 424
See application file for complete search history.

(56) References Cited

U.S. PATENT DOCUMENTS 1,780,289 A * 11/1930 Zepp ..... 439/427
2,309,311 A * 1/1943 Grohsgal ..... 439/418
(Continued)

FOREIGN PATENT DOCUMENTS

JP 09-082384 3/1997
JP 2003-132969 5/2003
(Continued)

OTHER PUBLICATIONS

International Search Report dated Jun. 18, 2013.

*Primary Examiner* — Phuongchi T Nguyen
(74) *Attorney, Agent, or Firm* — Gerald E. Hespos; Michael J. Porco; Matthew T. Hespos

(57) ABSTRACT

A terminal-provided wire (10) includes a wire (13) with a core (11) whose end is exposed, and a terminal (20) crimped to the end of the core (11) and connectable to a mating side. The terminal (20) includes a front terminal portion (21) and a rear terminal portion (22). The rear terminal portion (22) includes a bottom plate portion (26) on which the core (11) is to be placed, a pair of wire barrel portions (27) extending from the bottom plate portion (26) and to be crimped to the core (11), an easily breakable portion (28) extending in an axial direction from the bottom plate portion (26) and to be broken at the time of disassembling, and a fixing portion (29) extending in the axial direction from the easily breakable portion (28). The front terminal portion (21) includes an auxiliary crimping portion (25) to be placed on the bottom plate portion (26) in such a manner as to be sandwiched between the bottom plate portion (26) and the core (22) and to be crimped to the core (22) together with the wire barrel portions (27) to partly highly compress the core (22), a fixing portion (24) to be fixed to the fixing portion (29) and a connecting portion (23) extending in the axial direction from the fixing portion (24).

22 Claims, 20 Drawing Sheets

(51) Int. Cl.

| | |
|---|---|
| ***H01R 4/20*** | (2006.01) |
| ***H01R 4/62*** | (2006.01) |
| *H01R 4/18* | (2006.01) |

(56) References Cited

U.S. PATENT DOCUMENTS 2,453,615 A * 11/1948 Bergan ..... 439/430
2,515,105 A * 7/1950 Weisberg ..... 29/866
2,648,050 A * 8/1953 Berg ..... 439/424

FOREIGN PATENT DOCUMENTS

| | | |
|---|---|---|
| JP | 2003-151652 | 5/2003 |
| JP | 2003-178822 | 6/2003 |
| JP | 2010-062097 | 3/2010 |

* cited by examiner

TERMINAL AND TERMINAL-PROVIDED WIRE

BACKGROUND

1. Field of the Invention

The present invention relates to a terminal and a terminal-provided wire.

2. Description of the Related Art

Conventionally, there is known a terminal-provided wire in which a terminal is mounted on an end of an exposed core of a wire. This terminal includes a barrel in the form of a plate piece, and the terminal and the core are electrically connected by crimping (caulking) this barrel in such a manner as to be wind around the core.

An oxide film may be formed on a part of a core surface on which the terminal is to be crimped. This oxide film is a cause of increasing electric resistance between the core and the terminal and electric resistance among strands constituting the core. Thus, as described in Japanese Unexamined Patent Publication No. 2010-62097, the barrel is wound around the core with a high pressure in mounting the terminal on the core, thereby crushing and destroying the oxide film. If the oxide film is destroyed, a new core surface (new surface), which is not oxidized, appears from below. This new surface is utilized such as for electrical connection between the core and the terminal, thereby reducing the electric resistance described above.

Note that if the barrel is wound around the core with a high pressure to form a new surface, the core is highly compressed to become narrower. Thus, there is a possibility of core breakage (strand breakage) in that part. Particularly, if the core (strands) is made of aluminum, the core needs to be more compressed as compared with the case of a core made of copper to form a new surface by destroying an oxide film. Thus, the problem of core breakage (strand break) is more serious. Thus, as described in Japanese Unexamined Patent Publication No. 2010-62097, only a part of the barrel to be arranged on a tip side of the core is wound around the core with a high pressure to ensure high electrical connection (low electric resistance). A part of the barrel located behind this part is wound around the core with a lower pressure than at the tip side to ensure mechanical strength (particularly, tensile strength) of the terminal-provided wire while suppressing the core breakage and the like. A tip side of the barrel has a part (part where an extending piece is folded) thicker than a part behind it, and that part is raised toward an inner side (core side). If the core is fastened by the tip part of the barrel including this raised part, the core is highly compressed and the thickness (core diameter) thereof is reduced. Contrary to this, if the core is fastened by the rear part of the barrel having a small thickness, the core is compressed with a low pressure. Thus, the thickness (core diameter) thereof is not reduced as much as at the tip side and the strength of the core is ensured.

A terminal to be connected to an end of a core of a ground wire (hereinafter, ground terminal) is known as described in Japanese Unexamined Patent Publication No. 2003-178822. The ground terminal of this type is used by being firmly mounted at a predetermined position of a vehicle body utilizing a fixing member such as a bolt in a state crimped to an end of a ground wire.

Note that it is also described in Japanese Unexamined Patent Publication No. 2003-178822 that ground wires including such ground terminals are collected from discarded vehicles for a recycling (reutilization) purpose. A ground terminal is pulled in a state hooked to a J-shaped hook attached to a lifting apparatus such as a crane at the time of disassembling a discarded vehicle. At that time, the ground terminal is kept mounted on a vehicle body by a fixing member. When a force is applied to the ground terminal, the ground terminal is broken (cut) and the ground wire is removed from the vehicle side. Because of such a situation and the like, the ground terminal is required to have a configuration easily destroyable at the time of disassembling (easy disassemblability, disassembling easiness).

Conventionally, a terminal-provided wire has not been provided which is excellent in electrical connection performance between a terminal and a wire (core) and easy disassemblability.

The present invention was completed in view of the above situation and aims to provide a terminal-provided wire which has good electrical connection performance between a terminal and a wire (core) and is easily breakable at the time of disassembling and a terminal utilized therefor.

SUMMARY OF THE INVENTION

A terminal-provided wire of the present invention includes a wire with a core whose end is exposed, and a terminal crimped to the end of the core and connectable to a mating side, wherein the terminal includes a rear terminal portion with a bottom plate portion on which the core is to be placed, a pair of wire barrel portions respectively laterally extending from opposite ends of the bottom plate portion and to be crimped to wind around the core on the bottom plate portion, an easily breakable portion extending in an axial direction from the bottom plate portion and to be broken at the time of disassembling and a first fixing portion extending in the axial direction from the easily breakable portion, and a front terminal portion with an auxiliary crimping portion to be placed on the bottom plate portion in such a manner as to be sandwiched between the bottom plate portion and the core and to be crimped to the core together with the wire barrel portions to partly highly compress the core, a second fixing portion to be fixed to the first fixing portion in such a manner as to be placed on the first fixing portion and a connecting portion extending in the axial direction from the second fixing portion and to be connected to the mating side.

In the above terminal-provided wire, the easily breakable portion may be so broken that the bottom plate portion and the first fixing portion are separated from each other when the wire is pulled in a state where the connecting portion is connected to the mating side at the time of disassembling.

In the above terminal-provided wire, the easily breakable portion may include a hole portion or a cutout portion.

In the above terminal-provided wire, the front terminal portion may include a junction portion configured to join the auxiliary crimping portion and the second fixing portion and to be laid on the easily breakable portion.

In the above terminal-provided wire, the auxiliary crimping portion may be shaped along a circumferential direction of the core and grip a part of the core when being crimped to the core together with the wire barrel portions.

In the above terminal-provided wire, the second fixing portion of the front terminal may be so fixed to the first fixing portion of the rear terminal that the auxiliary crimping portion and the easily breakable portion are close to each other.

In the above terminal-provided wire, the terminal may be a ground terminal.

A terminal of the present invention is crimped to an end of a core of a wire including the core, whose end is exposed, and connectable to a mating side, and includes a rear terminal portion including a bottom plate portion on which the core is to be placed, a pair of wire barrel portions respectively laterally extending from opposite ends of the bottom plate portion and to be crimped to wind around the core on the bottom plate portion, an easily breakable portion extending in an axial direction from the bottom plate portion and to be broken at the time of disassembling and a first fixing portion extending in the direction from the easily breakable portion, and a front terminal portion including an auxiliary crimping portion to be placed on the bottom plate portion in such a manner as to be sandwiched between the bottom plate portion and the core and to be crimped to the core together with the wire barrel portions to partly highly compress the core, a second fixing portion to be fixed to the first fixing portion in such a manner as to be placed on the first fixing portion and a connecting portion extending in the axial direction from the second fixing portion and to be connected to the mating side.

According to the present invention, it is possible to provide a terminal-provided wire which has good electrical connection performance between a terminal and a wire (core) and is easily breakable at the time of disassembling and a terminal utilized therefor.

DETAILED DESCRIPTION OF THE PREFERRED EMBODIMENTS

First Embodiment

Version (1)

Figure 1:
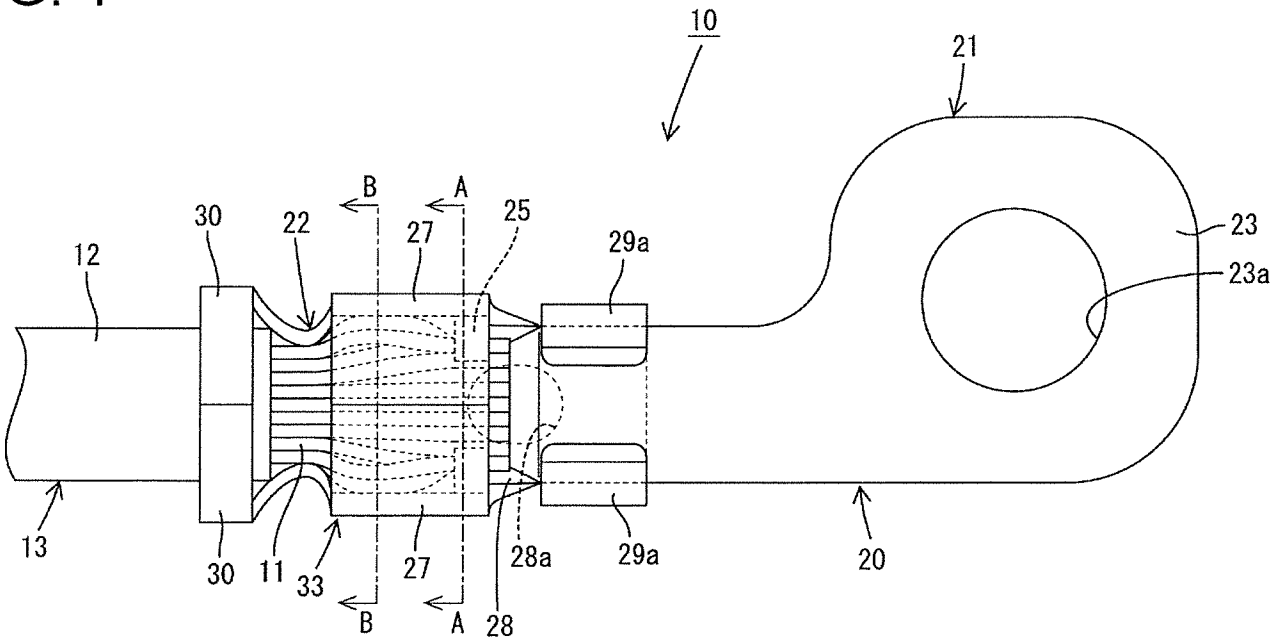
FIG. 1 is a top view of a terminal-provided wire according to first version of a first embodiment of the present invention.

A first version of the first embodiment of the present invention is described with reference to FIGS. 1 to 9. FIG. 1 is a top view (plan view) of a terminal-provided wire 10 according to the first version of the first embodiment of the present invention. Note that the terminal-provided wire 10 is described with a right side of FIG. 1 referred to as a tip side (front side) and a left side thereof referred to as a rear side (back side) for convenience of description. As shown in FIG. 1, the terminal-provided wire 10 includes a wire 13 with a core 11 whose terminal end (end) is exposed, and a terminal (ground terminal) 20 to be crimped to the end of the core 11.

The wire 13 includes the core 11 formed by twisting a plurality of metal thin wires (strands) and an insulation coating 12 made of synthetic resin for covering the outer periphery of the core 11. The core 11 is made of a metal material such as aluminum, aluminum alloy, copper or copper alloy. In the case of this embodiment, the core 11 (strands) is made of aluminum and a cross-sectional area thereof is about 12 mm2.

Figure 2:
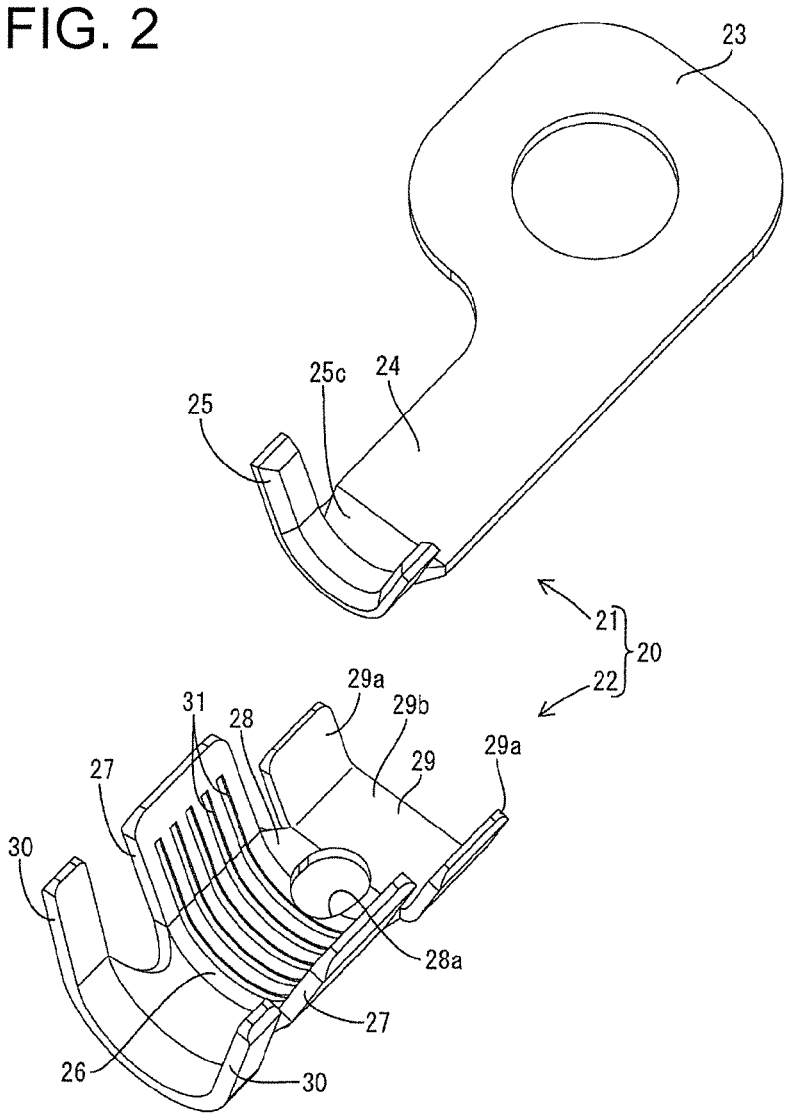
FIG. 2 is an exploded perspective view of a terminal.
Figure 3:
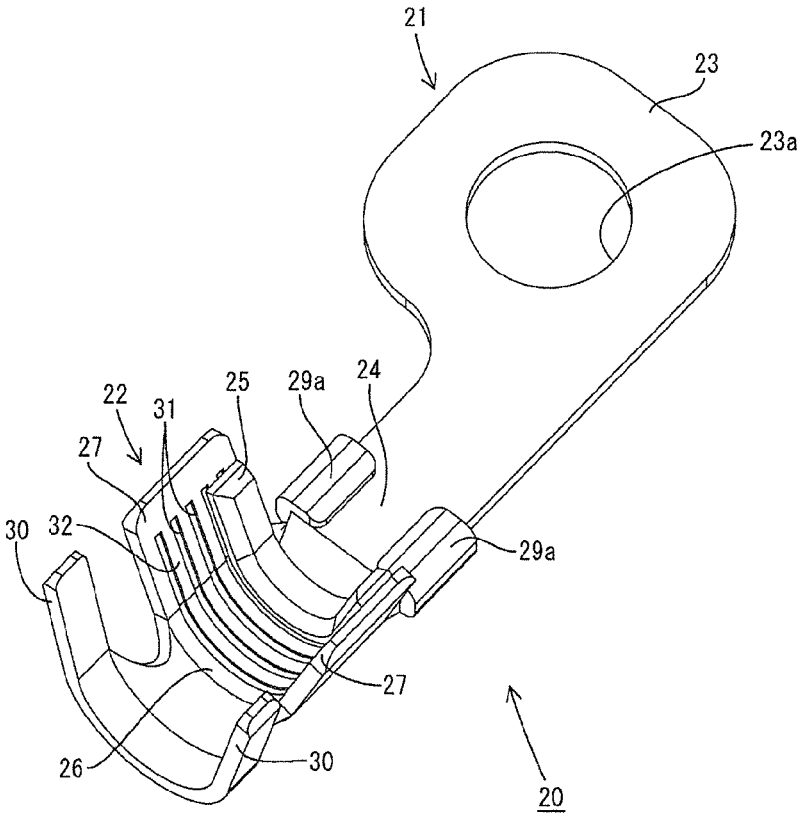
FIG. 3 is a perspective view of the terminal.

FIG. 2 is an exploded perspective view of the terminal 20, and FIG. 3 is a perspective view of the terminal 20. Note that the terminal 20 is described with an upper side of FIGS. 2 and 3 referred to as an inner side and a lower side thereof referred to as an outer side for convenience of description. As shown in FIGS. 2 and 3, the terminal 20 is composed of two types of parts. One part is a front terminal portion 21 arranged on a tip side and the other part is a rear terminal portion 22 arranged on a rear side. Each of the front and rear terminal portions 21, 22 constituting the terminal 20 is obtained by punching a metal plate material into a predetermined shape and pressing the punched piece into a predetermined shape. The plate material used for the terminal 20 is, for example, made of copper or copper alloy. Note that the plate material may be plated with tin, nickel or the like if necessary. In this embodiment, the plate material made of copper and plated with tin is used as the material of the terminal 20 (material of the front and rear terminal portions 21, 22).

The front terminal portion 21 includes a connecting portion 23, a second fixing portion 24, a junction portion 25*c* and an auxiliary crimping portion 25. Further, the rear terminal portion 22 includes a bottom plate portion 26, wire barrel portions 27, an easily breakable portion 28 and a first fixing portion 29. First, the rear terminal portion 22 is described in detail.

Figure 4:
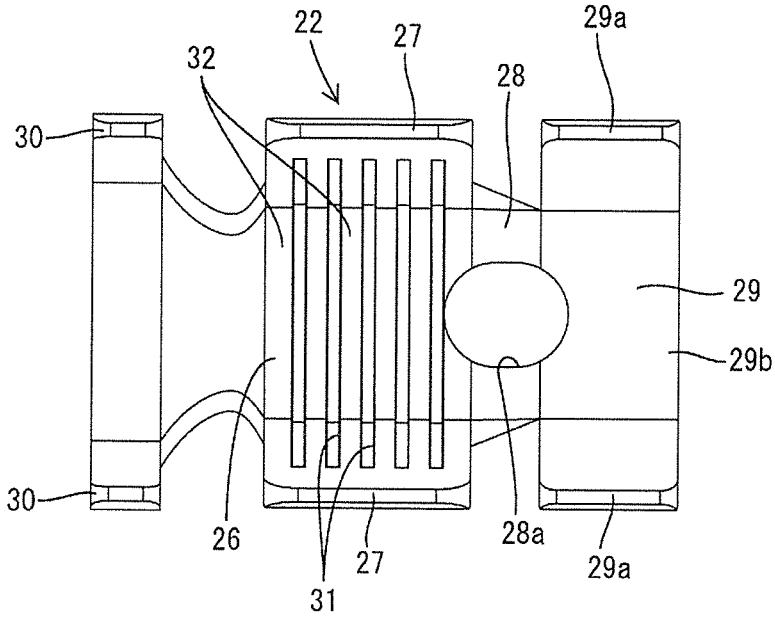
FIG. 4 is a top view of a rear terminal portion.

FIG. 4 is a top view of the rear terminal portion 22. The rear terminal portion 22 is shaped to be long in a front-back direction (length direction, axial direction of the wire 13 (core 11) and the like) as a whole. A thickness (plate thickness) of the rear terminal portion 22 is about 0.8 mm and a developed length (length in the front-back direction) thereof is about 22.0 mm. The bottom plate portion 26 of the rear terminal portion 22 is a part which is in the form of a plate extending in the front-back direction (axial direction) and on which the exposed end of the core 11 of the wire 13 is to be placed. Note that an end part of the wire 13 behind the exposed core 11 and covered with the insulation coating 12 is also placed on the bottom plate portion 26 together with the exposed core 11. The wire barrel portions 27, 27 made of a pair of plate pieces respectively laterally extending are provided on opposite ends of the bottom plate portion 26. The wire barrel portions 27, 27 are parts to be crimped to the core 11 in such a manner as to wind around the core 11 (embrace the core 11) placed on the bottom plate portion 26. The respective wire barrel portions 27, 27 have a substantially rectangular shape and stand up from the ends of the bottom plate portion 26 while facing at a distance from each other as shown in FIGS. 2 and 3 in a state before being crimped to the core 11.

Insulation barrel portions 30, 30 made of a pair of plate pieces respectively laterally extending are provided behind the wire barrel portions 27, 27 on the opposite ends of the bottom plate portion 26. The insulation barrel portions 30, 30 are parts to be crimped to the wire 13 in such a manner as to embrace the wire 13 placed on the bottom plate portion 26. The respective insulation barrel portions 30, 30 have a substantially long and narrow rectangular shape (strip shape) and stand up from the ends of the bottom plate portion 26 while facing at a distance from each other as shown in FIGS. 2 and 3 in a state before being crimped to the wire 13.

A plurality of groove portions 31 are formed to cross the bottom plate portion 26 from the one wire barrel portion 27 to the other wire barrel portion 27 on a surface (inner surface) on which the wire 13 (core 11) is to be placed. The groove portions 31 are arranged side by side in the front-back direction (axial direction) while being spaced apart from each other, and unevenness (serration) is formed on the surfaces (inner surfaces) of the bottom plate portion 26 and the wire barrel portions 27. Note that a part composed of the bottom plate portion 26 and the wire barrel portions 27 and to be crimped to the core 11 to hold the core 11 is particularly referred to as a core holding portion 33 in some cases for convenience of description.

If the aforementioned groove portions 31 are formed on a surface (inner surface) 32 of the core holding portion 33, the edges and the like of the groove portions 31 come into contact with the peripheral surface of the core 11, thereby making an oxide film formed on the core 11 easily destroyable, when the wire barrel portions 27 are crimped to the core 11. Note that, as described later, the auxiliary crimping portion 25 provided on the rear end of the front terminal portion 21 is placed on a front part of the bottom plate portion 26.

The easily breakable portion 28 extends forward from the bottom plate portion 26. The first fixing portion 29 extends further forward from this easily breakable portion 28. The easily breakable portion 28 is a part connecting the bottom plate portion 26 and the first fixing portion 29. A circular hole portion 28*a* is provided at an inner side of the easily breakable portion 28 and the easily breakable portion 28 connects the bottom plate portion 26 and the first fixing portion 29 in a state where the hole portion 28*a* is held therebetween at the inner side. A width of the easily breakable portion 28 connecting between them (width in a short side direction of the rear terminal portion 22) is smaller than the bottom plate portion 26 and the first fixing portion 29. Note that the easily breakable portion 28 has such a degree of mechanical strength (tensile strength) as to withstand normal use of the terminal-provided wire 10.

Further, the easily breakable portion 28 is broken at the time of disassembling the terminal-provided wire 10. At the time of disassembling, if the wire 13 of the terminal-provided wire 10 in a state where the connecting portion 23 is fixed such as by bolt fastening is pulled and a larger force than during normal use is applied to the terminal-provided wire 10 (terminal 20), the easily breakable portion 28 is broken (divided) so that the bottom plate portion 26 and the first fixing portion 29 are separated (divided) from each other.

Note that a rear part of the hole portion 28*a* of the easily breakable portion 28 is located on the side of the bottom plate portion 26 as shown in FIGS. 2 and 4. Further, a front part of the hole portion 28*a* is located on the side of the first fixing portion 29.

The first fixing portion 29 is a part arranged on the tip of the rear terminal portion 22 and fixed in a state laid on the second fixing portion 24 of the front terminal portion 21. When the first fixing portion 29 is fixed to the second fixing portion 24, the rear and front terminal portions 22, 21 are connected to each other, whereby one terminal 20 is obtained.

The first fixing portion 29 includes a substantially plate-like main body portion 29*b* and holding portions 29*a*, 29*a* made of a pair of plate pieces laterally extending from opposite ends of this main body portion 29*b*. The first fixing portion 29 is fixed to the second fixing portion 24 in such a manner that the second fixing portion 24 is placed on an inner surface of the first fixing portion 29. Specifically, the second fixing portion 24 is placed on the inner surface of the main body portion 29*b* and the respective holding portions 29*a*, 29*a* are bent toward the main body portion 29*b* and crimped (caulked) to the second fixing portion 24 to embrace the placed second fixing portion 24. Then, the first and second fixing portions 29, 24 are fixed in a close contact state. Note that the respective holding portions 29*a*, 29*a* before being bent stand up from the opposite ends of the main body portion 29*b* while facing at a distance from each other as shown in FIGS. 2 and 3.

Next, the front terminal portion 21 is described in detail. The front terminal portion 21 is shaped to be long in the front-back direction (length direction, axial direction of the wire 13 (core 11) and the like) as a whole. A thickness (plate thickness) of the front terminal portion 21 is about 0.8 mm and a developed length (length in the front-back direction) thereof is about 15.8 mm.

The auxiliary crimping portion 25 is provided on the rear end of the front terminal portion 21. This auxiliary crimping portion 25 is a part to be placed on the tip side of the bottom plate portion 26 of the rear terminal portion 22 and crimped to the core 11 together with the wire barrel portions 27, 27. The core holding portion 33 on the part where the auxiliary crimping portion 25 is arranged is a part for selectively (partly) highly compressing the tip part of the core 11 in the axial direction. The auxiliary crimping portion 25 of this embodiment is shaped to be long and narrow in a circumferential direction of the core 11. A length of the auxiliary crimping portion 25 (length in the circumferential direction of the core 11, length in a short side direction of the front terminal portion 21) is shorter than circumferential lengths of the core 11 before and after compression.

The auxiliary crimping portion 25 includes a first auxiliary crimping portion 25*a* to be placed on the bottom plate portion 26 and second auxiliary crimping portions 25*b*, 25*b* extending from opposite ends of the first auxiliary crimping portion 25*a* and to be placed at inner sides of the wire barrel portions 27, 27. As shown in FIGS. 2 and 3, in the auxiliary crimping portion 25 before being crimped to the core 11, the second auxiliary crimping portions 25*b*, 25*b* stand up from the opposite ends of the first auxiliary crimping portion 25*a* while facing at a distance from each other. The auxiliary crimping portion 25 is substantially U-shaped when viewed in the axial direction.

In the case of this embodiment, the auxiliary crimping portion 25 is so placed on the bottom plate portion 26 that the position of the front edge thereof substantially coincide with the positions of the front edges of the wire barrel portions 27 (i.e. accommodated in the core holding portion 33). The auxiliary crimping portion 25 is placed on the inner surface of the bottom plate portion 26 while being sandwiched between the bottom plate portion 26 and the core 11. When being placed on the bottom plate portion 26, the auxiliary crimping portion 25 is raised inwardly (toward the core 11) from the surface 32 of the core holding portion 22. That is, by placing the auxiliary crimping portion 25 on the surface 32 of the core holding portion 33, the core holding portion (bottom plate portion 26 and the wire barrel portions 27) 33 on a part where the auxiliary crimping portion 25 is placed can have a larger thickness (become thicker).

Note that, as described later, the auxiliary crimping portion 25 grips (holds) the peripheral surface of the tip side of the core 11 in the case of this embodiment when being crimped to the core 11 together with the wire barrel portions 27.

An outer surface of the auxiliary crimping portion 25 is facing some of the groove portions 31 formed on the surface 32 of the core holding portion 33. Further, the outer surface of the auxiliary crimping portion 25 covers a part of the hole portion 28*a* located on the bottom plate portion 26.

The substantially plate-like junction portion 25*c* is provided to extend forward from the auxiliary crimping portion 25 (first auxiliary crimping portion 25*a*). This junction portion 25*c* is a part joining the auxiliary crimping portion 25 and the second fixing portion 24. This junction portion 25*c* adjusts the position of the auxiliary crimping portion 25 placed on the bottom plate portion 26 by connecting (joining) the auxiliary crimping portion 25 and the second fixing portion 24. Further, this junction portion 25*c* is laid (placed) on the easily breakable portion 28 of the rear terminal portion 22 and has a function of reinforcing the easily breakable portion 28. In the case of this embodiment, the junction portion 25*c* is so laid on the easily breakable portion 28 to cover (close) most of the hole portion 28*a*.

The second fixing portion 24 is arranged more forward than the auxiliary crimping portion 25 and extends forward from the junction portion 25*c*. The second fixing portion 24 is a part to be fixed in a state placed on the inner surface of the first fixing portion 29 of the rear terminal portion 22. By fixing the second fixing portion 24 to the first fixing portion 29, the front and rear terminal portions 21, 22 are structurally and electrically connected to each other. The second fixing portion 24 is in the form of a flat plate and the connecting portion 23 extends before the second fixing portion 24.

The connecting portion 23 is a part arranged on the tip of the terminal 20 and to be fixed to a mating side such as a predetermined position of a vehicle body such as by bolt fastening. The connecting portion 23 is in the form of a flat plate as a whole and shaped such that a tip side is larger than a rear side. An insertion hole 23*a* into which a fixing member such as a bolt is to be inserted is provided on the tip side of the connecting portion 23.

When such a front terminal portion 21 is assembled with the rear terminal portion 22, the terminal portion 20 is obtained. In assembling the front terminal portion 21 with the rear terminal portion 22, the second fixing portion 24 of the front terminal portion 21 in a state where the connecting portion 23 is facing forward is first placed on the first fixing portion 29 (main body portion 29*b*) on the tip side of the rear terminal portion 22 while being positioned. At that time, the auxiliary crimping portion 25 located on the rear end of the front terminal portion 21 is also positioned to be arranged at a predetermined position of the bottom plate portion 26 of the front terminal portion 21. Subsequently, the pair of holding portions 29*a*, 29*a* of the first fixing portion 29 are respectively bent utilizing a predetermined crimping apparatus and crimped (caulked) to the second fixing portion 24. Then, the terminal 20 in a state before being mounted on the wire 13 as shown in FIG. 3 is obtained.

Figure 5:
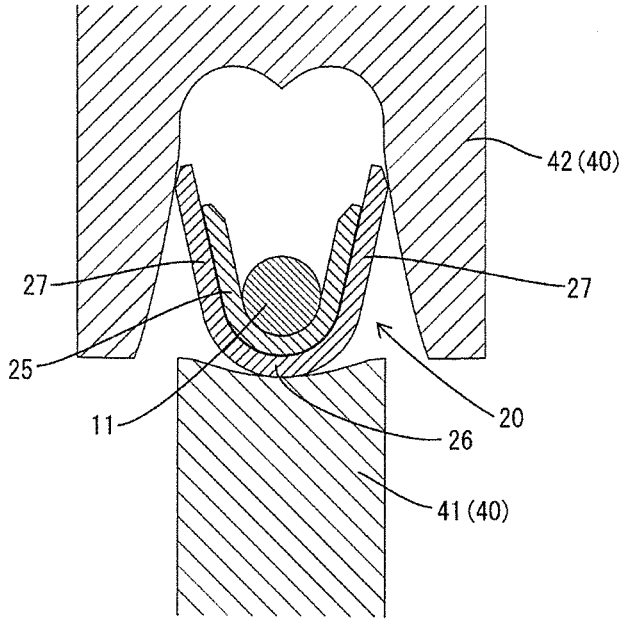
FIG. 5 is a diagram schematically showing a process of crimping an auxiliary crimping portion to a core together with wire barrel portions using a crimping apparatus.

Next, a process of producing the terminal-provided wire 10 by crimping (caulking) the terminal 20 to the end of the wire 13 including the exposed core 11 is described with reference to FIG. 5 and other figures. FIG. 5 is a diagram schematically showing the process of crimping the auxiliary crimping portion 25 to the core 11 together with the wire barrel portions 27 utilizing a crimping apparatus 40. In the process of crimping the terminal 20 to the end of the core 11, the predetermined crimping apparatus 40 as shown in FIG. 5 is utilized. The crimping apparatus includes an anvil 41 arranged on a lower side of FIG. 5 and a crimper 42 arranged above this anvil 41. The terminal 20 in a state where the core 11 (wire 13) is placed on the bottom plate portion 26 is arranged on the anvil 41. At that time, the tip part of the core 11 is placed on the auxiliary crimping portion 25 as shown in FIG. 5.

When the crimper 42 is lowered toward the anvil 41 after the terminal 20 and the wire 13 (core 11) are placed on the anvil 41 in this way, the terminal 20 and the end of the core 11 are sandwiched between the crimper 42 and the anvil 41. Then, the respective wire barrel portions 27, 27 are crimped to wind around the core 11 (embrace the core 11). Particularly, at a position where the auxiliary crimping portion 25 is arranged, the auxiliary crimping portion 25 is crimped to the core 11 together with the wire barrel portions 27, 27 as shown in FIG. 5. Note that the respective insulation barrels 30, 30 are also crimped to the wire 13 in such a manner as to embrace the end part of the wire 13 (insulation coating 12) together with the wire barrel portions 27 and the like. In this way, the terminal-provided wire 10 as shown in FIG. 1 is obtained.

In the core holding portion 33 of the terminal-provided wire 10, a compression rate of the core 11 differs at a tip part 33*a* and a rear part 33*b*. The auxiliary crimping portion 25 is provided at an inner side of the tip part 33*a* (part on the side of the connecting portion 23) of the core holding portion 33, and this tip part 33*a* compresses the core 11 more than the rear part 33*b* of the core holding portion 33.

Figure 6:
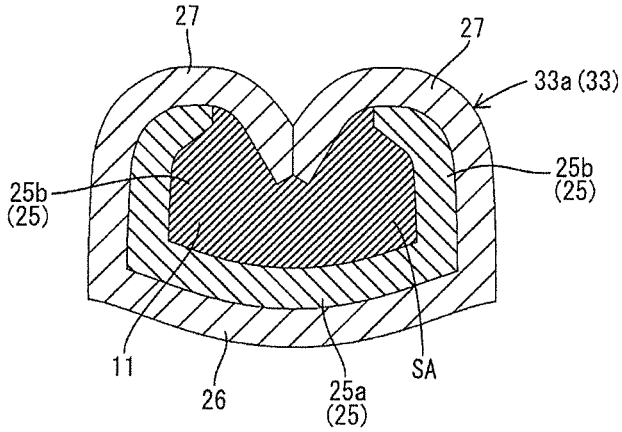
FIG. 6 is a section along A-A of FIG. 1.
Figure 7:
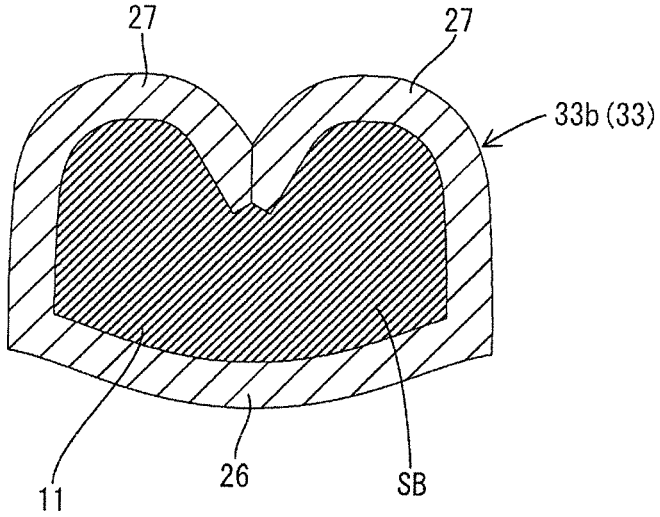
FIG. 7 is a section along B-B of FIG. 1.

FIG. 6 is a section along A-A of FIG. 1 and FIG. 7 is a section along B-B of FIG. 1. FIG. 6 shows a cross-sectional structure of the tip part 33*a* of the core holding portion 33 where the auxiliary crimping portion 25 is arranged. Contrary to this, FIG. 7 shows a cross-sectional structure of the rear part 33*b* of the core holding portion 33 where the auxiliary crimping portion 25 is not arranged. A comparison of FIGS. 6 and 7 reveals that a cross-sectional area SA of the core 11 shown in FIG. 6 is smaller than a cross-sectional area SB of the core 11 shown in FIG. 7. A diameter (outer diameter, circumferential length) of the core holding portion 33 is set substantially equal at the tip part 33*a* and the rear part 33*b* of the core holding portion 33, but an inner diameter of the core holding portion 33 is smaller at the tip part 33*a* than at the rear part 33*b* by as much as the auxiliary crimping portion 25. Thus, the tip part 33*a* where the auxiliary crimping portion 25 is provided can press (fasten) the peripheral surface of the core 11 with a higher pressure than the rear part 33*b*. As a result, the core 11 located inside the tip part 33*a* is thinner than the core 11 located inside the rear part 33*b*.

The compression rate of the core 11 located inside the tip part 33*a* is set at about 30 to 50% and more preferably at about 35 to 45%. Note that the compression rate of the core 11 is (cross-sectional area of the core after compression)/(cross-sectional area of the core before compression)×100(%). That is, the smaller the value of the compression rate is, the more the core 11 is compressed. If the compression rate at the tip part 33*a* is set at such a value, the oxide film formed on the surface of the core 11 is reliably easily destroyed and a new surface is reliably easily exposed from below the oxide film. As a result, electric resistance between the core 11 and the terminal 20 (core holding portion 33) and electric resistance among the strands constituting the core 11 are reduced at the tip part 33*a* and good electrical connection performance is ensured between the core 11 and the terminal 20. Note that the core 11 located inside the tip part 33*a* is fixed (gripped) along the circumferential direction of the core 11 by the auxiliary crimping portion 25.

Contrary to this, the compression rate of the core 11 located inside the rear part 33*b* is set at about 60 to 90% and more preferably at about 70 to 80%. If the compression rate at the rear part 33*b* is set at such a value, the core 11 is compressed less than at the tip part 33*a*, wherefore the breakage of the core 11 (breakage of the stands constituting the core 11) is suppressed. As a result, good mechanical strength (tensile strength) of the core 11 is ensured at the rear part 33*b* and, consequently, a good holding force of the terminal 20 (core holding portion 33) for the core 11 is ensured.

In this way, in the terminal-provided wire 10, good electrical connection performance between the core 11 and the terminal 20 (core holding portion 33) is ensured without impairing mechanical strength necessary during normal use.

The terminal-provided wire 10 of this embodiment is used (normal use) in a state arranged as a so-called ground wire in a vehicle. The terminal 20 provided on one end of the terminal-provided wire 10 is fixed at a predetermined position of a vehicle body as a mating side of the terminal-provided wire 10 by bolt fastening. A fixing bolt (not shown) firmly fixes the terminal 20 to the vehicle body in a state inserted into the insertion hole 23*a* on the connecting portion 23. Note that the connecting portion 23 of the terminal 20 is firmly sandwiched between a head part (not shown) of the bolt and the vehicle body. Note that the other end of the terminal-provided wire 10 is connected to a predetermined device (not shown) mounted in the vehicle.

The terminal-provided wire 10 of this embodiment is structured to have easy disassemblability (disassembling easiness) in addition to the aforementioned electrical connection performance. The content of easy disassemblability is described below. After the end of normal use, the terminal-provided wire 10 is collected from the discarded vehicle such as for a recycling (reutilization) purpose. During the collection, the terminal-provided wire 10 is pulled with the wire 13 hooked to a J-shaped hook attached to a lifting apparatus such as a crane. At that time, a large force beyond a permissible range during normal use is applied to the terminal-provided wire 10 (particularly to the terminal 20). For example, if the wire 13 of the terminal-provided wire 10 shown in FIG. 1 is pulled backward (left side of FIG. 1) in a state hooked to the hook when the connecting portion 23 is fixed to the vehicle body by bolt fastening, the easily breakable portion 28 of the terminal 20 crimped to the core 11 is broken (cut) and the wire 13 is torn off from the vehicle body side. If the easily breakable portion 28 is broken, the terminal-provided wire 10 is disassembled to be divided into a front part 50 (part on the side of the connecting portion 23) and a rear part 60 (part on the side of the wire 13) at the easily breakable portion 28.

Figure 8:
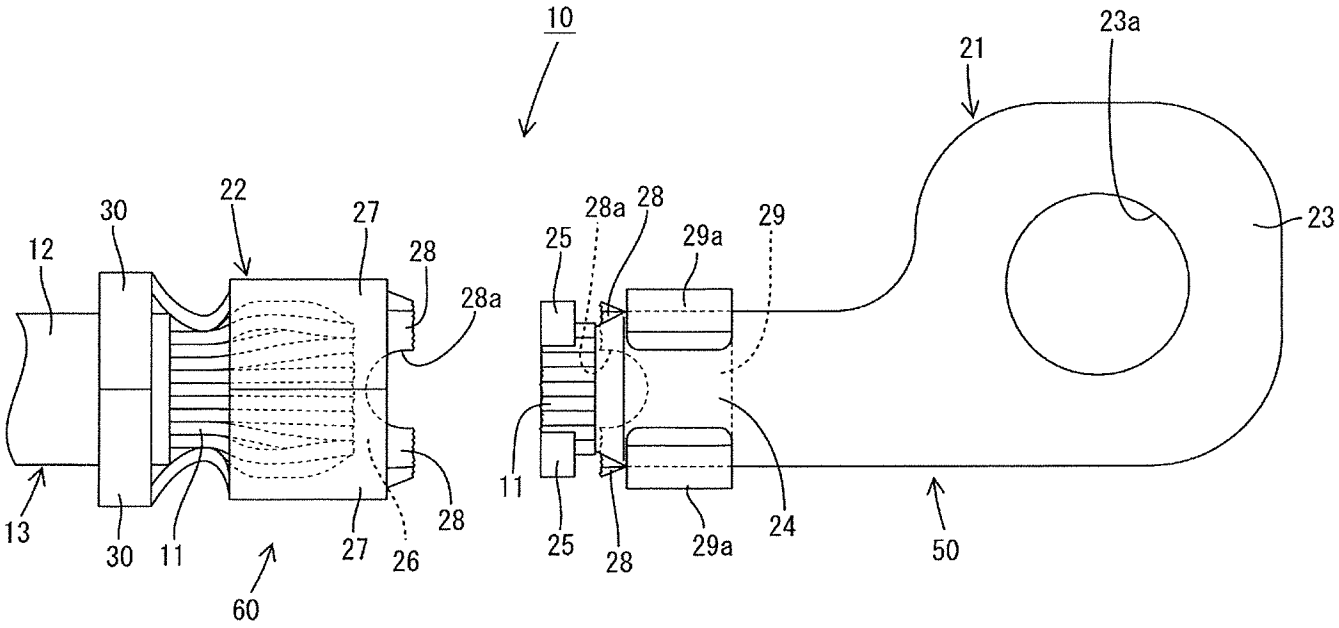
FIG. 8 is a diagram schematically showing the terminal-provided wire divided into a front part and a rear part at an easily breakable portion at the time of disassembling.
Figure 9:
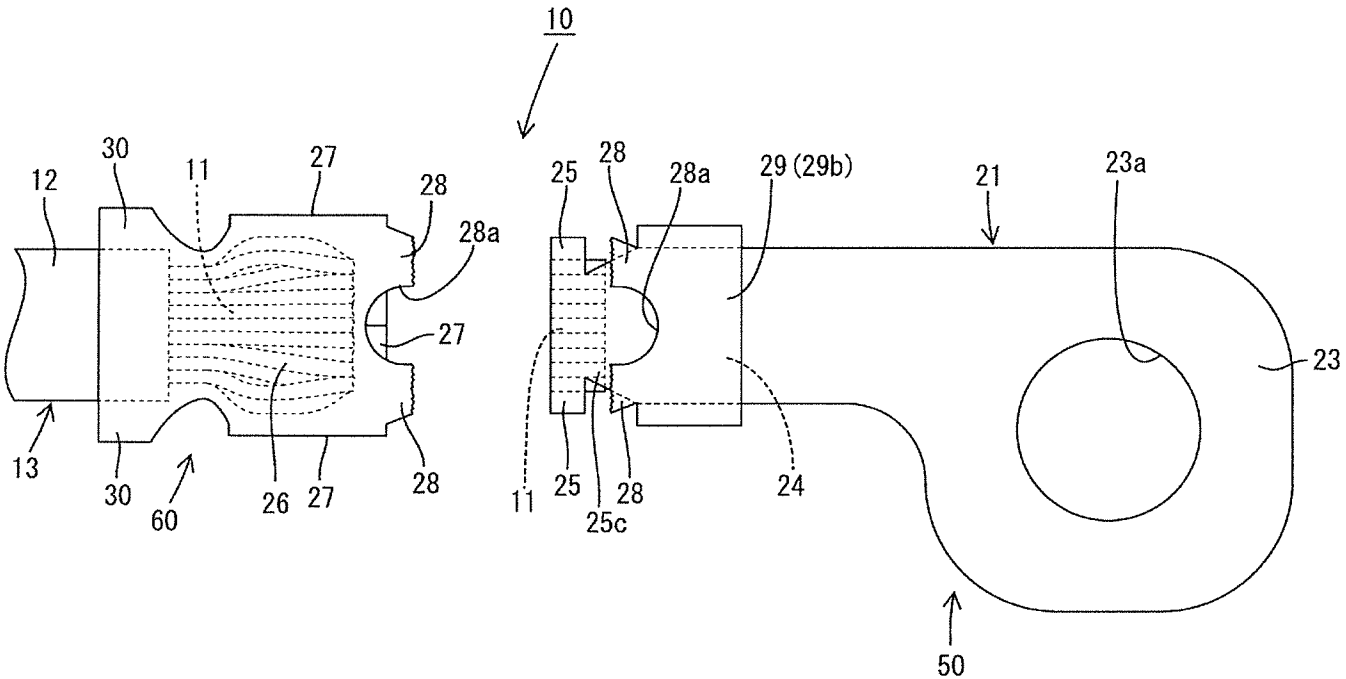
FIG. 9 is a diagram schematically showing an underside of the terminal-provided wire shown in FIG. 8.

FIG. 8 is a diagram schematically showing the terminal-provided wire 10 divided into the front part 50 and the rear part 60 at the easily breakable portion 28 at the time of disassembling, and FIG. 9 is a diagram schematically showing an underside of the terminal-provided wire 10 shown in FIG. 8. When being disassembled as shown in FIGS. 8 and 9, the terminal-provided wire 10 is divided into the front part 50 including the connecting portion 23 and the rear part 60 including the wire 13. At that time, the terminal 20 is so broken (cut) that the easily breakable portion 28 is divided into a side on the bottom plate portion 26 and a side on the first fixing portion 29. The easily breakable portion 28 is a part set to have a shortest width (width in the short side direction of the terminal 20) (to be narrowest) in the terminal 20 and weakest in terms of strength. Note that the terminal 20 has such a degree of strength (tensile strength) that the easily breakable portion 28 is not broken during normal use.

Further, when the wire 13 is pulled by the hook at the time of disassembling, the core 11 is also cut at or near its part highly compressed by the auxiliary crimping portion 25 and divided into the front part 50 and the rear part 60.

The front part 50 is mainly composed of the front terminal portion 21, the first fixing portion 29 fixed to the second fixing portion 24 of the front terminal portion 21 and a cut piece of the core 11 gripped (held) by the auxiliary crimping portion 25. The first fixing portion 29 is fixed to the second fixing portion 24 of the front terminal portion 21 also after the easily breakable portion 28 is broken.

On the other hand, the rear part 60 is mainly composed of the rear terminal portion 22 remaining after the breakage of the easily breakable portion 28 and the wire 13 on which this rear terminal portion 22 is mounted. Note that the auxiliary crimping portion 25 included in the front part 50 is accommodated in the part surrounded by the wire barrel portions 27 and the bottom plate portion 26 (core holding portion 33) before the easily breakable portion 28 is broken (during normal use). However, if the easily breakable portion 28 is broken at the time of disassembling, the auxiliary crimping portion 25 as a part of the front terminal portion 21 is pulled forward and removed from the substantially tubular core holding portion 33 (part surrounded by the wire barrel portions 27 and the bottom plate portion 26). At that time, the auxiliary crimping portion 25 tears off a part (tip part) of the core 11 and is removed from the rear part 60 (side of the wire 13) while gripping the cut piece of the core.

As just described, the terminal-provided wire 10 of this embodiment is easily disassembled into the front part 50 and the rear part 60 by breaking the easily breakable portion 28 of the terminal 20 and cutting the highly compressed tip part (or vicinity of the tip part) of the core 11.

In the terminal-provided wire 10, the position of the auxiliary crimping portion 25 and that of the easily breakable portion 28 are close (proximate) to each other. That is, the terminal-provided wire 10 is broken near the part where the core 11 is crimped (core crimping portion 33). By setting the position of the auxiliary crimping portion 25 and that of the easily breakable portion 28 in this way, disassemblability of the terminal-provided wire 10 is enhanced.

In the terminal-provided wire 10 of this embodiment, the terminal 20 is set to be broken not near the connecting portion 23, but near the part where the core 11 is crimped (core crimping portion 33). Thus, the connecting portion 23 needs not be unnecessarily enlarged (e.g. to ensure a position to provide the easily breakable portion). Thus, even if a mounting spot of the vehicle body is small, the terminal-provided wire 10 of this embodiment can be reliably mounted on that mounting spot while having easy disassemblability. Further, there is no possibility that the easily breakable portion does not function by being sandwiched between the fixing member and the mounting spot depending on the size of the fixing member such as a bolt. Even if the connecting portions 23 of a plurality of terminal-provided wires 10 are fixed by bolt fastening in a state where the connecting portions 23 are placed one over another while a bolt is inserted into each insertion hole 23*a*, there is no possibility that the respective connecting portions 23 interfere with each other to impair easy disassemblability of each terminal-provided wire 10. In addition, in such a case, the terminal-provided wire 10 can be selectively removed at the time of disassembling. For example, it is also possible to select and remove only terminal-provided wires 10 that need to be removed.

Further, since the easily breakable portion 28 is not arranged near the connecting portion 23 in the terminal-provided wire 10 of this embodiment, it is not necessary to lay a plate member for reinforcing the vicinity of the connecting portion 23. In the case of this embodiment, the easily breakable portion 28 is reinforced by being placed on a part (junction portion 25*c*) of the front terminal portion 21. Thus, a thickness increase of the connecting portion 23 is suppressed in the terminal-provided wire 10 of this embodiment. As a result, even if the connecting portions 23 of a plurality of terminal-provided wires 10 are mounted on a predetermined spot of the vehicle body in a state placed one over another, the enlargement of the mounting spot can be suppressed.

As described above, the terminal-provided wire 10 (and terminal 20) of this embodiment has good electrical connection performance between the terminal 20 and the wire 13 (core 11) and is configured to be easily breakable at the time of the disassembling.

First Embodiment

Version (2)

Figure 10:
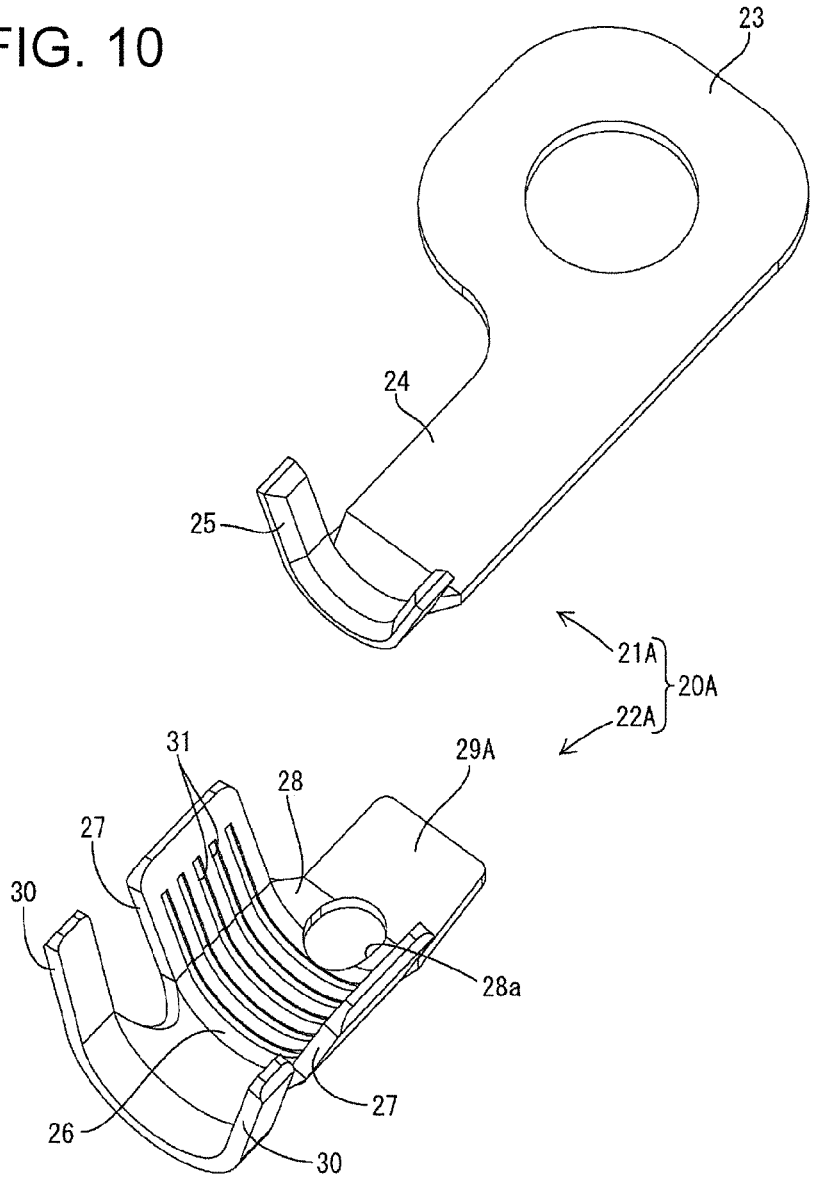
FIG. 10 is an exploded perspective view of a terminal according to a second version of the first embodiment.
Figure 11:
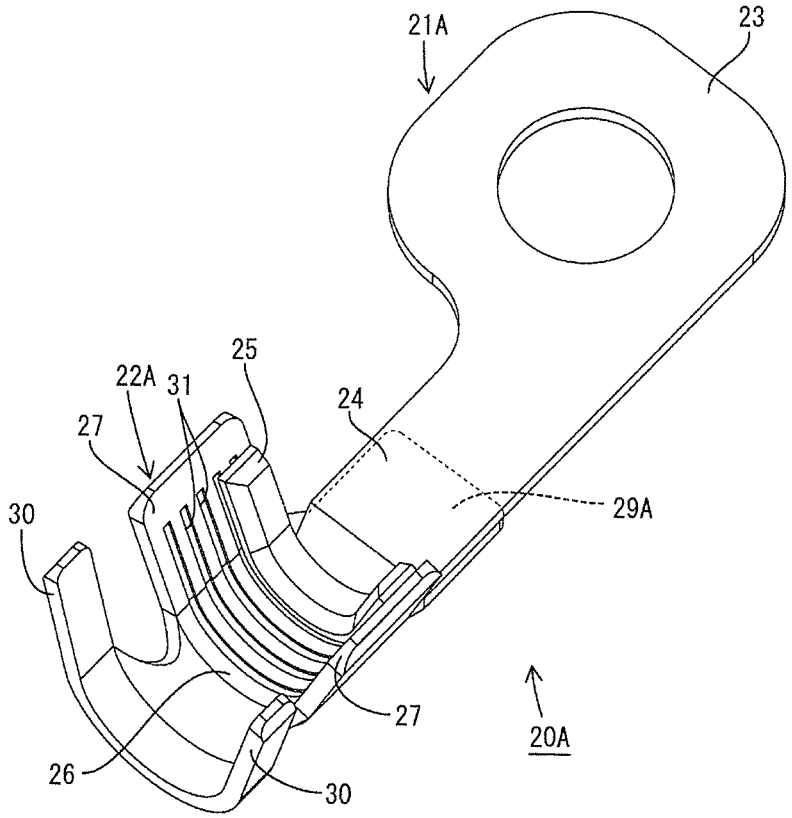
FIG. 11 is a perspective view of the terminal according to the embodiment of FIG. 10.

Next, a second version of the first embodiment is described with reference to FIGS. 10 and 11. Note that the same components as in the first version of the first embodiment illustrated in FIGS. 1 to 9 are denoted by the same reference signs and not described in detail. FIG. 10 is an exploded perspective view of a terminal 20A in the second version of the first embodiment and FIG. 11 is a perspective view of the terminal 20A in the second version of the first embodiment (2). The terminal 20A of this embodiment is a ground terminal as in the first embodiment (1) and used by being crimped to an end part of a wire 13 similar to that of the first embodiment (1).

As shown in FIG. 10, the terminal 20A of this embodiment is composed of a front terminal portion 21A and a rear terminal portion 22A. The configuration of the front terminal portion 21A of this embodiment is the same as the front terminal portion 21 of the first embodiment (1). Further, the configuration of the rear terminal portion 22A of this embodiment is the same as the rear terminal portion 22 of the first embodiment (1) except that the holding portions 29*a* of the first embodiment (1) are not provided on a first fixing portion 29A. In the case of this embodiment, the first fixing portion 29A of the rear terminal portion 22A and a second fixing portion 24 of the front terminal portion 21A are fixed by pin point welding by laser irradiation. In this way, the first fixing portion 29A of the rear terminal portion 22A and the second fixing portion 24 of the front terminal portion 21A may be fixed in a state laid one over the other to form the terminal 20A. The terminal 20A of this embodiment also achieves the same technical effects as in the first embodiment (1).

Second Embodiment

Conventionally, a terminal-provided wire including a wire with a core and a terminal connected to the core exposed at an end of the wire is known from Japanese Unexamined Patent Publication No. 2010-62097.

An oxide film may be formed on a core surface of a part where a terminal is to be crimped. This oxide film is a cause of increasing electric resistance between the core and the terminal and electric resistance among strands constituting the core. Thus, as described in patent literature 1, a barrel is wound around the core with a high pressure, thereby crushing and destroying the oxide film, when the terminal is mounted on the core. If the oxide film is destroyed, a new core surface (new surface), which is not oxidized, appears from below. This new surface is utilized such as for electrical connection between the core and the terminal, thereby reducing the electric resistance described above.

A ground terminal to be connected to an end of a core of a ground wire is known as a terminal as described in patent literature 2. The ground terminal of this type is used by being firmly mounted at a predetermined position of a vehicle body utilizing a fixing member such as a bolt in a state crimped to an end of the ground wire.

Note that it is also described in Japanese Unexamined Patent Publication No. 2003-132969 that ground wires including such ground terminals are collected from discarded vehicles for a recycling (reutilization) purpose. A ground terminal is pulled in a state hooked to a J-shaped hook attached to a lifting apparatus such as a crane at the time of disassembling a discarded vehicle. At that time, the ground terminal is kept mounted on a vehicle body by a fixing member. When a force is applied to the ground terminal, the ground terminal is broken (cut) and the ground wire is removed from the vehicle side. Because of such a situation and the like, the ground terminal is required to have a configuration easily destroyable at the time of disassembling (easy disassemblability, disassembling easiness).

Conventionally, a terminal-provided wire has not been provided which is excellent in electrical connection performance between a terminal and a wire (core) and easy disassemblability.

The technology described in this description was completed based on the above situation and aims to provide a terminal-provided wire which has good electrical connection performance between a terminal and a wire (core) and is easily breakable at the time of disassembling and a terminal utilized therefor.

The technology described in this description is directed to a terminal-provided wire including a wire with a core and a terminal connected to the core exposed from an end of the wire, wherein the terminal includes a wire barrel portion to be crimped to the core, an extending portion extending from the wire barrel portion, a laminate portion as a member separate from the extending portion laid on the extending portion, an auxiliary crimping portion extending from the laminate portion toward the wire barrel portion and to be crimped to the core in a state sandwiched between the wire barrel portion and the core, a connecting portion extending from the laminate portion in a direction different from the auxiliary crimping portion and to be connected to a mating member, a locking portion configured to lock the extending portion and the laminate portion and release the extending portion and the laminate portion from a locked state when a force is applied to the wire, and an easily breakable portion formed between a locked portion locked by the locking portion out of the laminate portion and the auxiliary crimping portion and easily breakable when a force is applied to the wire.

Further, the technology described in this description is directed to a terminal including a wire barrel portion to be crimped to a core exposed from an end of a wire including the core, an extending portion extending from the wire barrel portion, a laminate portion laid on the extending portion, an auxiliary crimping portion extending from the laminate portion toward the wire barrel portion and to be crimped to the core in a state sandwiched between the wire barrel portion and the core, a connecting portion extending from the laminate portion in a direction different from the auxiliary crimping portion and to be connected to a mating member, a locking portion configured to lock the extending portion and the laminate portion and release the extending portion and the laminate portion from a locked state when a force is applied to the wire, and an easily breakable portion formed between a locked portion locked by the locking portion out of the laminate portion and the auxiliary crimping portion and easily breakable when a force is applied to the wire.

According to the technology described in this description, the core is crimped by the wire barrel portion and the auxiliary crimping portion. This causes the core to be more crimped as compared with the case where the core is crimped only by the wire barrel portion. As a result, an oxide film formed on the surface of the core is peeled off and a metal surface constituting the core is exposed. By the contact of this exposed metal surface and the wire barrel portion, an electric resistance value between the wire and terminal can be reduced.

Further, according to the technology described in this description, the extending portion and the laminate portion are released from the locked state when a force is applied to the wire at the time of disassembling. Further, the easily breakable portion is broken when a force is applied to the wire. Then, the laminate portion as a member separate from the extending portion is separated from the extending portion.

As just described, according to the technology described in this description, the terminal-provided wire has good electrical connection performance between the terminal and the wire (core) and is easily breakable at the time of disassembling.

The following modes are preferable as embodiments of the technology described in this description.

The core preferably includes a low compression portion crimped only by the wire barrel portion and a high compression portion more compressed than the low compression portion by being crimped by both the wire barrel portion and the auxiliary crimping portion.

According to the above mode, a holding force of the core and the wire barrel portion can be improved in the low compression portion.

Further, an electric resistance value between the core and the terminal can be reduced in the high compression portion.

The core includes a plurality of strands made of metal, and a compression rate of the low compression portion is set to be higher than 50% and that of the high compression portion is set to be preferably lower than 50%, more preferably not higher than 35%, further preferably not higher than 25% and particularly preferably not higher than 20% when the compression rate is defined to be (cross-sectional area of the core after compression)/(cross-sectional area of the core before compression)×100(%).

By setting the compression rate to be lower than 50%, the oxide film of the core can be destroyed. This can reduce the electric resistance value between the core and the terminal. Further, if the compression rate is set to be not higher than 35%, the electric resistance value can be reduced since the surfaces of the strands constituting the core microscopically adhere to each other. Further, if the compression rate is set to be not higher than 25%, the electric resistance value can be further reduced since the strands macroscopically adhere to each other. Further, if the compression rate is set to be not higher than 20%, the electric resistance value can be reliably reduced since the strands can reliably adhere to each other.

The easily breakable portion is preferably formed into a groove.

According to the above mode, the easily breakable portion can be reliably broken at the time of disassembling by simply forming the easily breakable portion into a groove.

The locking portion is preferably formed into claws extending toward opposite lateral sides from the tip of the extending portion.

According to the above mode, the extending portion and the laminate portion can be locked by simply bending the locking portion formed into the claws. Further, the number of components can be reduced as compared with the case where the locking portion is formed as a separate member.

The locked portion is formed with a tapered surface for opening and deforming the locking portion by coming into contact with the locking portion.

According to the above mode, the locking portion can be reliably opened and deformed and the locked state of the extending portion and the laminate portion can be released at the time of disassembling by simply forming the tapered surface.

According to the technology described in this description, it is possible to provide a terminal-provided wire which has good electrical connection performance between a terminal and a wire (core) and is easily breakable at the time of disassembling and a terminal utilized therefor.

Figure 12:
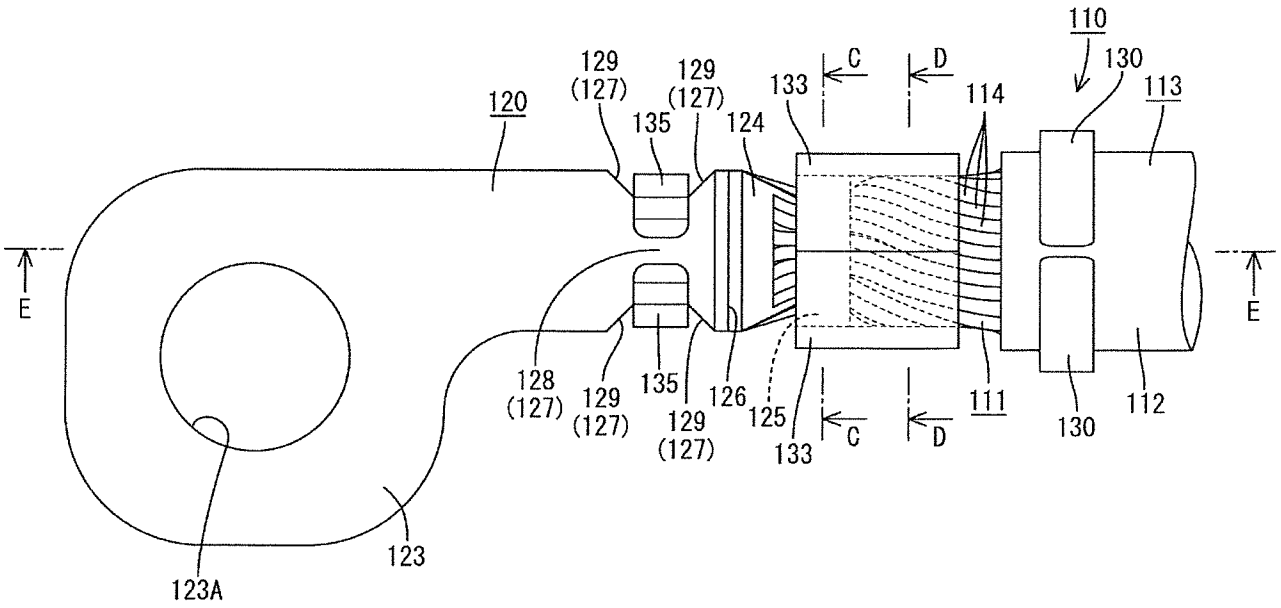
FIG. 12 is a plan view showing a terminal-provided wire according to a second embodiment of the present invention.

A second embodiment of the present invention is described with reference to FIGS. 12 to 22. FIG. 12 is a plan view of a terminal-provided wire 110 according to the second embodiment of the present invention. Note that a left side in FIG. 12 is referred to as a tip side (front side) and a right side is referred to as a rear side (back side) for convenience of description. As shown in FIG. 12, the terminal-provided wire 110 includes a wire 113 with a core 111 whose terminal end (end) is exposed, and a terminal 120 to be crimped to the end of the core 111. In this embodiment, the terminal 120 is a ground wire to be mounted in an unillustrated vehicle.

The wire 113 includes the core 111 formed by twisting a plurality of strands 114 made of metal and an insulation coating 112 made of synthetic resin for covering the outer periphery of the core 111. The core 111 is made of a metal material such as aluminum, aluminum alloy, copper or copper alloy. In the case of this embodiment, the core 111 is made of aluminum or aluminum alloy and a cross-sectional area thereof is about 12 mm2.

Figure 13:
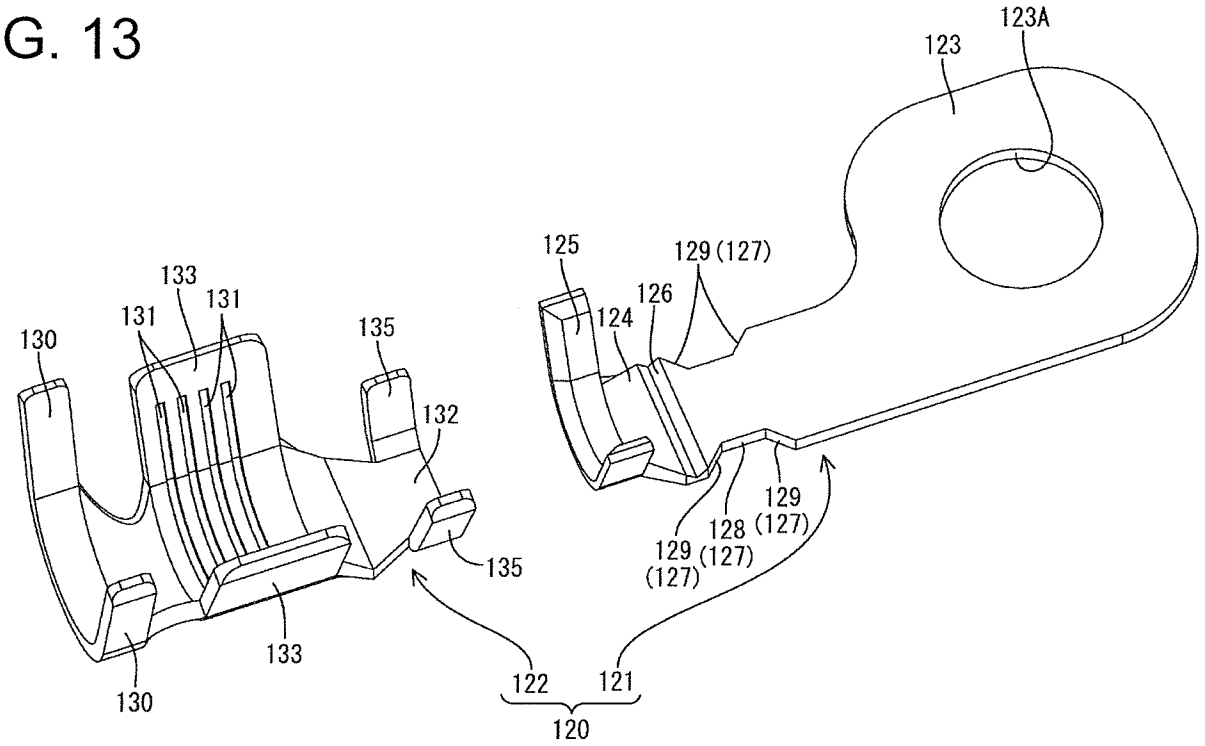
FIG. 13 is an exploded perspective view of a terminal.
Figure 14:
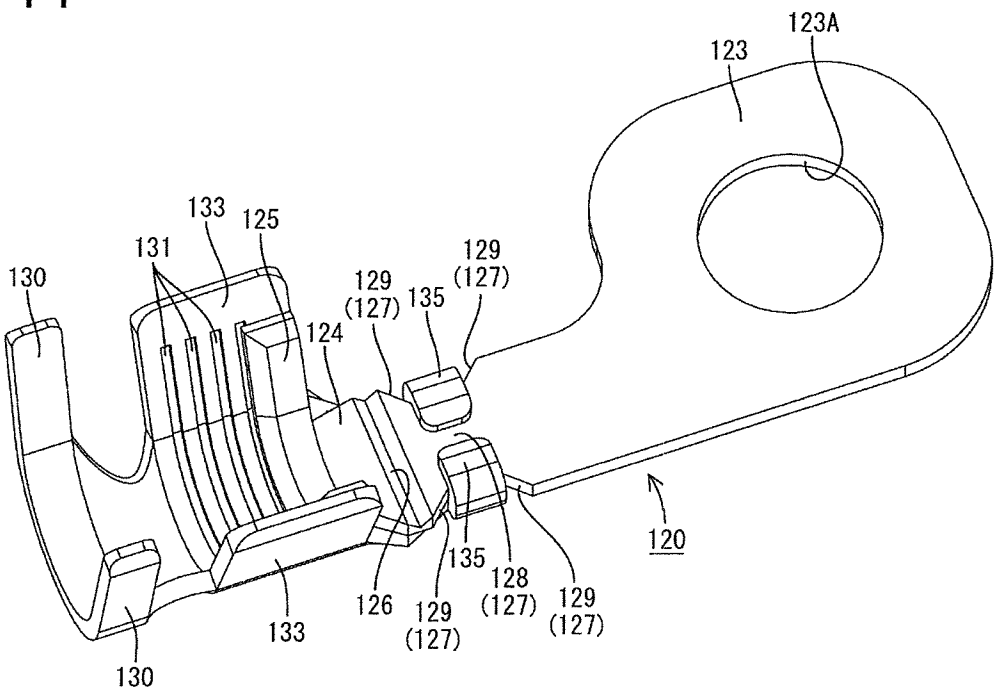
FIG. 14 is a perspective view of the terminal.

FIG. 13 is an exploded perspective view of the terminal 120, and FIG. 14 is a perspective view of the terminal 120. Note that the terminal 120 is described with an upper side of FIGS. 13 and 14 referred to as an inner side and a lower side thereof referred to as an outer side for convenience of description. As shown in FIGS. 12 and 14, the terminal 120 is composed of two types of parts. One part is a front terminal portion 121 arranged on a tip side and the other part is a rear terminal portion 122 arranged on a rear side. Each of the front and rear terminal portions 121, 122 constituting the terminal 120 is obtained by punching a metal plate material into a predetermined shape and pressing the punched piece into a predetermined shape. The plate material used for the terminal 120 is, for example, a metal material such as copper, copper alloy, aluminum, aluminum alloy, iron and iron alloy. Note that the plate material may be plated with tin, nickel or the like if necessary. In this embodiment, the plate material made of copper alloy and plated with tin is used as the material of the terminal 120 (material of the front and rear terminal portions 121, 122).

The front terminal portion 121 includes a connecting portion 123, a laminate portion 124, an easily breakable portion 126 and an auxiliary crimping portion 125. Further, the rear terminal portion 122 includes an extending portion 132, a wire barrel portion 133 and an insulation barrel portion 130 and locking portions 135. First, the rear terminal portion 122 is described in detail.

As shown in FIG. 13, the rear terminal portion 122 is shaped to be long in a front-back direction (length direction, axial direction of the wire 113 (core 11) and the like) as a whole. A thickness (plate thickness) of the rear terminal portion 122 is about 0.8 mm. The extending portion 132 of the rear terminal portion 122 is in the form of a plate extending in the front-back direction (axial direction). The extending portion 132 extends from the wire barrel portion 133 to be crimped to the core 111. The wire barrel portion 133 is made of a pair of laterally extending plate pieces. The wire barrel portion 133 is crimped to the core 111 in such a manner as to wind around the core 111 (embrace the core 111).

The insulation barrel portion 130 is provided behind the wire barrel portion 133. The insulation barrel portion 130 is a part to be crimped to the insulation coating 112 of the wire 113 in such a manner as to embrace the wire 113.

A plurality of groove portions 131 are formed to extend in a direction perpendicular to the axial direction of the wire 113 on a surface (inner surface) of the wire barrel portion 133 on which the wire 113 (core 111) is to be placed. The groove portions 131 are arranged side by side in the front-back direction (axial direction) while being spaced apart from each other.

If the aforementioned groove portions 131 are formed on the inner surface of the wire barrel, the hole edges of the groove portions 131 come into contact with the peripheral surface of the core 111, thereby making an oxide film formed on the core 111 easily destroyable, when the wire barrel portion 133 is crimped to the core 111. Note that, as described later, the auxiliary crimping portion 125 provided on the rear end of the front terminal portion 21 is placed on a front part of the wire barrel portion 133.

A pair of locking portions 135 in the form of laterally extending claws are formed on a front side of the extending portion 132. The pair of locking portions 135 are bent onto the laminate portion 124 laid on the extending portion 132, thereby locking the extending portion 132 and the laminate portion 124. The locking portions 135 are opened and deformed to release the extending portion 132 and the laminate portion 124 from a locked state when a tensile force is applied to the wire 113 at the time of disassembling.

Next, the front terminal portion 121 is described in detail. The front terminal portion 121 is shaped to be long in the front-back direction (length direction, axial direction of the wire 113 (core 111) and the like) as a whole. A thickness (plate thickness) of the front terminal portion 121 is about 0.8 mm.

The auxiliary crimping portion 125 is provided on the rear end of the front terminal portion 121. This auxiliary crimping portion 125 is a part to be laid on a tip side of the wire barrel portion 133 of the rear terminal portion 122 and crimped to the core 111 together with the wire barrel portion 133. A part composed of the wire barrel portion 133 and the auxiliary crimping portion 125 and to be crimped to the core 111 is a part for selectively (partly) highly compressing a tip part of the core 111 in the axial direction. The auxiliary crimping portion 125 of this embodiment is shaped to be long and narrow in a circumferential direction of the core 111. A length of the auxiliary crimping portion 125 (length in the circumferential direction of the core 111, length in a short side direction of the front terminal portion 121) is shorter than circumferential lengths of the core 111 before and after compression.

Figure 15:
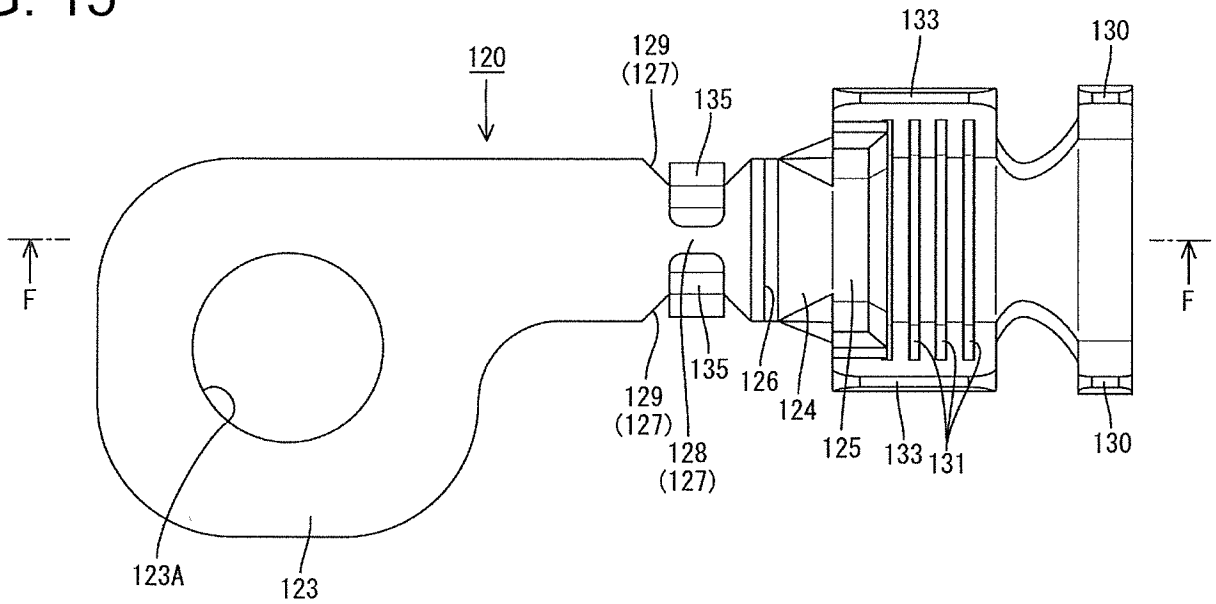
FIG. 15 is a plan view of the terminal.
Figure 16:
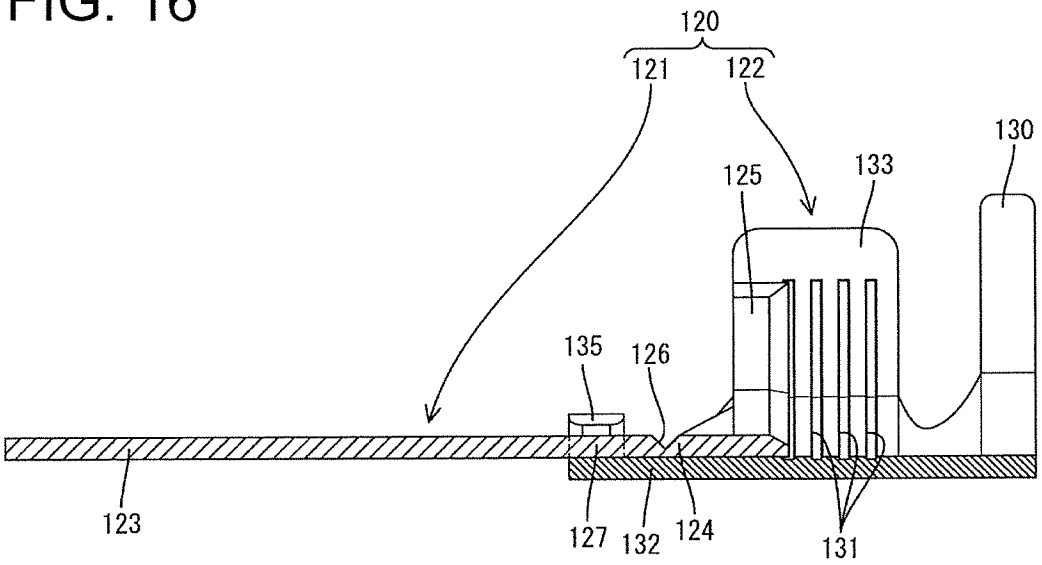
FIG. 16 is a section along F-F of FIG. 15.

As shown in FIG. 15, in the case of this embodiment, the auxiliary crimping portion 125 is so placed on the wire barrel portion 133 that the position of the front edge thereof substantially coincides with that of the front edge of the wire barrel portion 133. The auxiliary crimping portion 125 is placed on the inner surface of the wire barrel portion 133 in such a manner as to be sandwiched between the wire barrel portion 133 and the core 111. When being placed on the wire barrel portion 133, the auxiliary crimping portion 125 is raised inwardly (toward the core 111) from the surface of the wire barrel portion 133. That is, by placing the auxiliary crimping portion 125 on the surface of the wire barrel portion 133, a part where the auxiliary crimping portion 125 is placed can have a larger thickness (become thicker).

Note that, as described later, the auxiliary crimping portion 125 grips (holds) the peripheral surface of the tip side of the core 111 in the case of this embodiment when being crimped to the core 111 together with the wire barrel portion 133.

The substantially plate-like laminate portion 124 is provided to extend forward from the auxiliary crimping portion 125. This laminate portion 124 is a part for joining the auxiliary crimping portion 125 and the connecting portion 123. The laminate portion 124 is laid on the extending portion 132.

The laminate portion 124 is formed with a locked portion 127 to be locked by the locking portions 135 described above. The locked portion 127 includes a narrow portion 128 narrower than other parts. The aforementioned locking portions 135 are bent and caulked to the narrow portion 128. Out of the locked portion 127, the narrow portion 128 formed to be narrower and the other parts of the laminate portion 124 are coupled by tapered surfaces 129. These tapered surfaces 129 come into contact with the bent locking portions 135 to open and deform the locking portions 135 when a tensile force is applied to the wire 113 at the time of disassembling.

The laminate portion 124 is formed with the easily breakable portion 126 which is located between the locked portion 127 and the auxiliary crimping portion 125 and easily broken when a tensile force is applied to the wire 113 at the time of disassembling. In this embodiment, the easily breakable portion 126 is formed into a groove perpendicular to the axial direction of the wire 113. The strength of the easily breakable portion 126 is so set that the easily breakable portion 126 is easily broken when a tensile force is applied to the wire 113 at the time of disassembling.

As described above, the laminate portion 124 is laid on the extending portion 132. In this way, the easily breakable portion 126 is reinforced by the extending portion 132 (see FIG. 16).

The connecting portion 123 extends forward of the locked portion 127. The connecting portion 123 is a part to be arranged on the tip of the terminal 120 and fixed to a mating side such as a predetermined position of a vehicle body such as by bolt fastening. The connecting portion 123 is in the form of a flat plate as a whole and shaped such that a tip side is larger than a rear side. An insertion hole 123A into which a fixing member such as a bolt is to be inserted is provided on the tip side of the connecting portion 123.

When such a front terminal portion 121 is assembled with the rear terminal portion 122, the terminal portion 120 is obtained. In assembling the front terminal portion 121 with the rear terminal portion 122, the laminate portion 124 of the front terminal portion 121 in a state where the connecting portion 123 is facing forward is first placed on the extending portion 132 on the tip of the rear terminal portion 122 while being positioned. At that time, the auxiliary crimping portion 125 located on the rear end of the front terminal portion 121 is also positioned to be arranged at a predetermined position of the wire barrel portion 133 of the front terminal portion 121. Subsequently, the pair of locking portions 135 formed on the tip of the extending portion 132 are respectively bent utilizing a predetermined crimping apparatus and crimped (caulked) to the locked portion 127. Then, the terminal 120 in a state before being mounted on the wire 113 as shown in FIG. 14 is obtained.

In the wire barrel portion 133 of the terminal-provided wire 110, a compression rate of the core 111 differs at a tip part and a rear part. Since the auxiliary crimping portion 125 is provided at an inner side of the tip part (part on the side of the connecting portion 123) of the wire barrel portion 133, this tip part compresses the core 11 more than the other part (rear part) where the auxiliary crimping portion 125 is not arranged.

Figure 17:
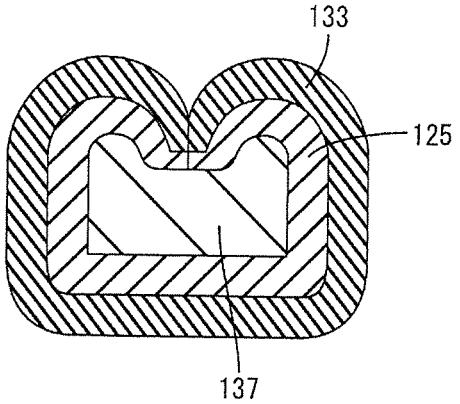
FIG. 17 is a section along C-C of FIG. 12.
Figure 18:
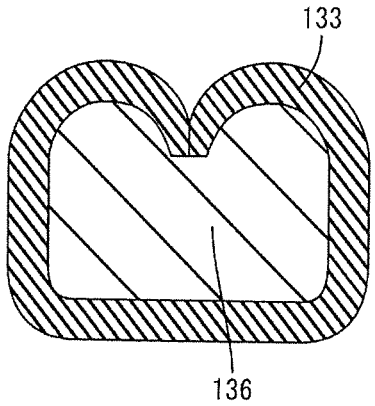
FIG. 18 is a section along D-D of FIG. 12.

FIG. 17 is a section along C-C of FIG. 12 and FIG. 18 is a section along D-D of FIG. 12. FIG. 17 shows a cross-sectional structure of the tip part of the wire barrel portion 133 where the auxiliary crimping portion 125 is arranged. Contrary to this, FIG. 18 shows a cross-sectional structure of the rear part of the wire barrel portion 133 where the auxiliary crimping portion 125 is not arranged. A comparison of FIGS. 17 and 18 reveals that a cross-sectional area of the core 111 shown in FIG. 17 is smaller than a cross-sectional area of the core 111 shown in FIG. 18. The outer shape of the wire barrel portion 133 is set substantially the same at the tip part and the rear part of the wire barrel portion 133, but the outer shape of the core 111 is smaller at the tip part (see FIG. 17) than at the rear part (see FIG. 18) by as much as the auxiliary crimping portion 125. Thus, the tip part where the auxiliary crimping portion 25 is provided can press (fasten) the peripheral surface of the core 111 with a higher pressure than the rear part. As a result, the core 111 located inside the tip part is thinner than the core 111 located inside the rear part. The core 111 at the tip part shown in FIG. 17 is a high compression portion 137 and the core 111 at the rear part shown in FIG. 18 is a low compression portion 136.

The compression rate of the core 111 in the high compression portion 137 is set to be preferably lower than 50%, more preferably not higher than 35%, further preferably not higher than 25% and particularly preferably not lower than 20%. Note that the compression rate of the core 111 is (cross-sectional area of the core after compression)/(cross-sectional area of the core before compression)×100(%). That is, the smaller the value of the compression rate is, the more the core 111 is compressed. If the compression rate in the high compression portion 137 is set at such a value, the oxide film formed on the surface of the core 111 is reliably easily destroyed and a new surface is reliably easily exposed from below the oxide film. As a result, electric resistance between the core 111 and the terminal 120 (wire barrel portion 133) and electric resistance among the strands 114 constituting the core 111 are reduced in the high compression portion 137 and good electrical connection performance is ensured between the core 111 and the terminal 20. Note that the core 111 located in the high compression portion 137 is fixed (gripped) along the circumferential direction of the core 111 by the auxiliary crimping portion 125.

Contrary to this, the compression rate of the core 111 in the low compression portion 136 is preferably set to be higher than 50%, more preferably 60 to 90% and particularly preferably 70 to 80%. If the compression rate in the low compression portion 136 is set at such a value, the core 111 is compressed less than in the high compression portion 137, wherefore the breakage of the core (breakage of the stands 114 constituting the core 111) is suppressed. As a result, good mechanical strength (tensile strength) of the core 111 is ensured in the low compression portion 136 and, consequently, a good holding force of the terminal 120 (wire barrel portion 133) for the core 111 is ensured.

By setting the compression rate to be lower than 50%, the oxide film of the core 111 can be destroyed. This can reduce an electric resistance value between the core 111 and the terminal 120. Further, if the compression rate is set to be not higher than 35%, the electric resistance value can be reduced since the surfaces of the strands 114 constituting the core 111 microscopically adhere to each other. Further, if the compression rate is set to be not higher than 25%, the electric resistance value can be further reduced since the strands 114 macroscopically adhere to each other. Further, if the compression rate is set to be not higher than 20%, the electric resistance value can be reliably reduced since the strands 114 can reliably adhere to each other.

Further, the strands 114 constituting the core 111 strongly rub against each other in an area between the high compression portion 137 and the low compression portion 136. As a result, oxide films formed on the surfaces of the strands 114 are destroyed and metal surfaces constituting the strands 114 are exposed. By the contact of these metal surfaces, an electric resistance value among the stands 114 can be reduced. In this way, the strands 114 located near the center of the core can also contribute to electrical connection to the terminal 120. As a result, the electric resistance value between the core 111 and the terminal 120 can be further reduced.

In this way, in the terminal-provided wire 110, good electrical connection performance between the core 111 and the terminal 120 is ensured without impairing mechanical strength necessary during normal use.

The terminal-provided wire 110 of this embodiment is used (normal use) in a state arranged as a so-called ground wire in a vehicle. The terminal 120 provided on one end of the terminal-provided wire 110 is fixed at a predetermined position of a vehicle body as a mating side of the terminal-provided wire 110 by bolt fastening. A fixing bolt (not shown) firmly fixes the terminal 120 to the vehicle body in a state inserted into the insertion hole 123A on the connecting portion 123. Note that the connecting portion 123 of the terminal 120 is firmly sandwiched between a head part (not shown) of the bolt and the vehicle body. Note that the other end of the terminal-provided wire 110 is connected to a predetermined device (not shown) mounted in the vehicle.

Figure 19:
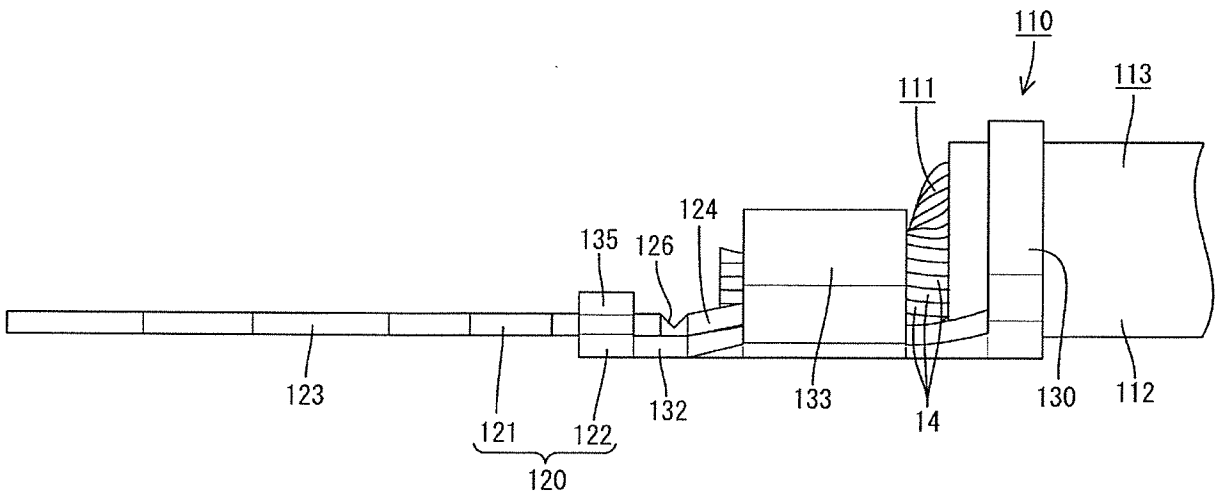
FIG. 19 is a side view showing the terminal-provided wire.

The terminal-provided wire 110 of this embodiment is structured to have easy disassemblability (disassembling easiness) in addition to the aforementioned electrical connection performance. The content of easy disassemblability is described below. After the end of normal use, the terminal-provided wire 110 is collected from the discarded vehicle such as for a recycling (reutilization) purpose. During the collection, the terminal-provided wire 110 is pulled with the wire 113 hooked to a J-shaped hook attached to a lifting apparatus such as a crane. At that time, a large force beyond a permissible range during normal use is applied to the terminal-provided wire 110 (particularly to the terminal 120). For example, if the wire 113 of the terminal-provided wire 110 shown in FIG. 19 is pulled in a state hooked to the hook when the connecting portion 123 is fixed to the vehicle body by bolt fastening, the wire 113 is pulled upwardly in FIG. 19.

Figure 20:
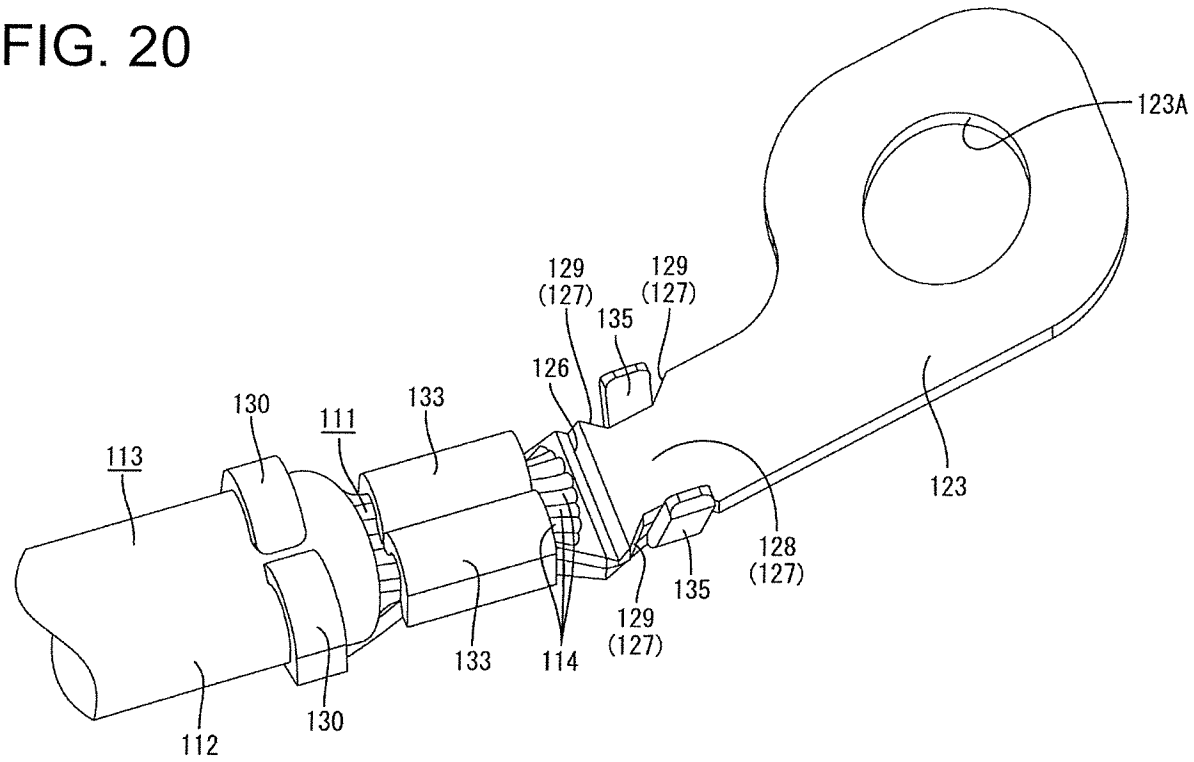
FIG. 20 is a perspective view showing a state where locking portions are opened and deformed at the time of disassembling.

Then, as shown in FIG. 20, the tapered surfaces 129 formed on the locked portion 127 press the pair of locking portions 135 upwardly to open and deform the pair of locking portions 135 as the wire 113 is pulled upward. In this way, the extending portion 132 and the laminate portion 124 are separated.

Figure 21:
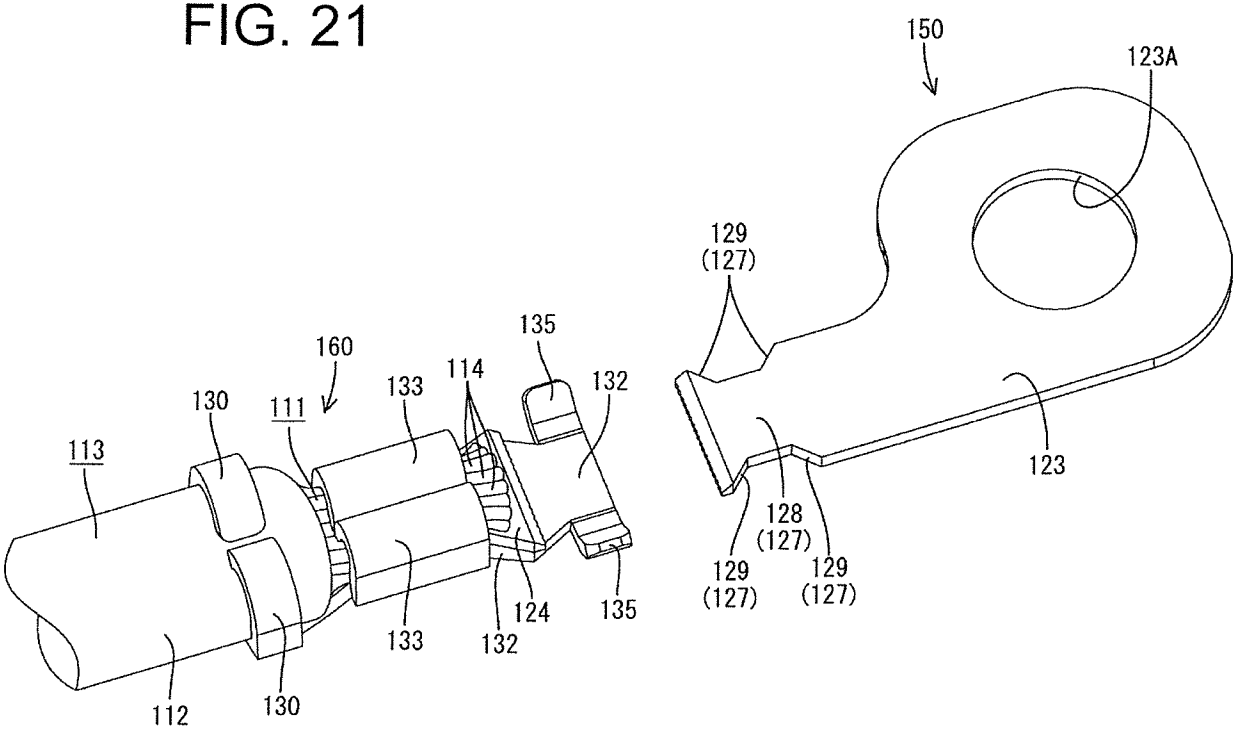
FIG. 21 is a perspective view showing a state where the terminal is divided.

If the wire 113 is further pulled upwardly, the easily breakable portion 126 formed on the laminate portion 124 is broken. Then, as shown in FIG. 21, the terminal-provided wire 110 is disassembled to be divided into a tip part 150 (part on the side of the connecting portion 123) and a rear part 160 (part on the side of the wire 113) at the easily breakable portion 126.

Figure 22:
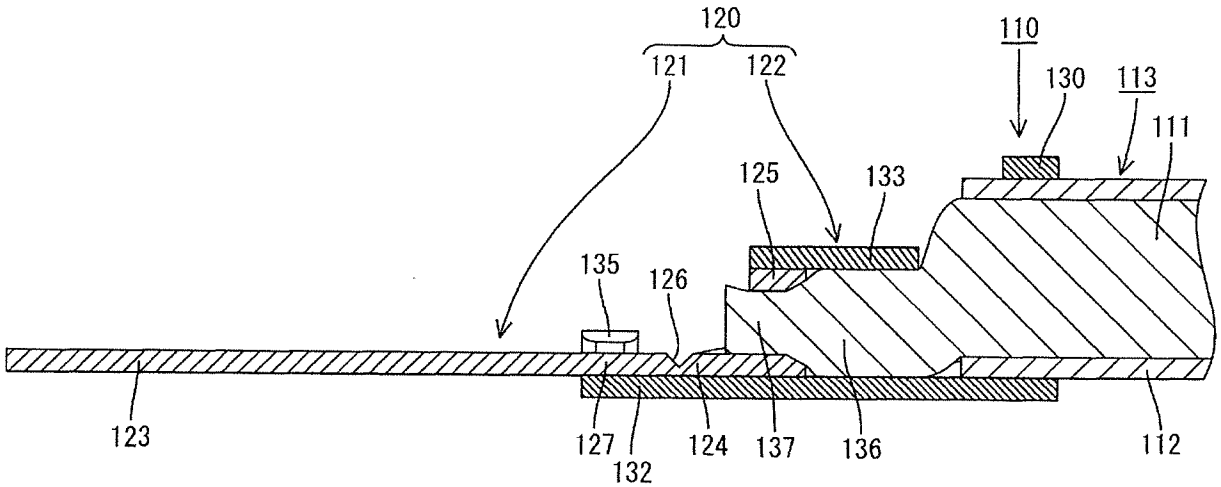
FIG. 22 is a section along E-E of FIG. 12.

Note that, as shown in FIG. 22, the easily breakable portion 126 of the laminate portion 124 is reinforced from below by the extending portion 132 during normal use. Thus, the easily breakable portion 126 is not broken by a force applied to the wire 113 during normal use.

As just described, the terminal-provided wire 110 of this embodiment is easily disassembled into the tip part 150 and the rear part 160 by opening the locking portions 135 and breaking the easily breakable portion 126.

Other Embodiments

The present invention is not limited to the above described and illustrated embodiments. For example, the following embodiments are also included in the technical scope of the present invention.

In the above embodiment, the easily breakable portion 28 includes the circular hole portion 28*a*. In another embodiment, a hole portion having another shape such as a triangular shape or a rectangular shape may be formed. Besides such a hole portion, the easily breakable portion may be provided with a cutout portion. The shape of the easily breakable portion is appropriately set according to a purpose.

In the above embodiment, the auxiliary crimping portion 25 used can grip the core 11 at the time of crimping the core. In another embodiment, the auxiliary crimping portion may be shaped not to grip the core. That is, the auxiliary crimping portion may be structured to highly compress the core at the time of crimping the core, but not to grip the core after crimping. For example, the auxiliary crimping portion may have a length (length in the short side direction of the terminal) shorter than in the above embodiment (auxiliary crimping portion having a U shape). Even in such a structure, the core part highly compressed by the auxiliary crimping portion is a part easily breakable at the time of disassembling. Thus, if the wire is pulled and a force is applied thereto at the time of disassembling, the easily breakable portion of the terminal is broken and the auxiliary crimping portion is pulled out from the core holding portion as the core is destroyed. However, the auxiliary crimping portion preferably grips the core at the time of crimping the core as in the above first embodiment (1). If the auxiliary crimping portion 25 grips the core 11 in this way, the terminal-provided wire 10 is more reliably easily disassembled at the time of disassembling.

Although the ground terminal is illustrated in the above embodiments, a terminal other than the ground terminal may be used in another embodiment. For example, such a terminal as to be connected to a mating terminal (so-called male terminal or female terminal) may be used.

Although the terminal-provided wire for vehicle is illustrated in the above embodiments, the terminal-provided wire (and terminal) of the present invention may be utilized for other applications (houses, outdoor facilities, etc.).

Although the terminal-provided wire is removed utilizing a crane or the like at the time of disassembling in the above embodiments, it may be manually removed by an operator. Note that the terminal-provided wire of the present invention has such a degree of strength as to be broken for a purpose other than disassembling, for example, during a manual removing operation.

Although each compression rate of the core 11 is illustrated in the above embodiment, the present invention is not limited to this content.

Although the easily breakable portion 126 is formed into a groove in the above second embodiment, there is no limitation to this and the easily breakable portion 126 may be a plurality of through holes arranged at predetermined intervals in a discrete manner.

Although the locking portions 135 are formed into a pair of claws laterally extending from the extending portion 132 in the above second embodiment, there is no limitation to this and the locking portions 135 may be members separate from the front and rear terminal portions 121, 122. For example, the locking portions 135 may be formed into long and narrow metal plates and crimped to wind around the outer peripheries of the extending portion 132 and the laminate portion 124.

LIST OF REFERENCE SIGNS

10: terminal-provided wire
11: core
12: insulation coating
13: wire
20: terminal
21: front terminal portion
22: rear terminal portion
23: connecting portion
23*a*: insertion hole
24: second fixing portion
25*c*: junction portion
25: auxiliary crimping portion
26: bottom plate portion
27: wire barrel portion
28: easily breakable portion
28*a*: hole portion
29: first fixing portion
29*a*: holding portion
29*b*: main body portion
30: insulation barrel portion
31: groove portion
32: surface (inner surface) of core holding portion
33: core holding portion
110: terminal-provided wire
111: core
113: wire
114: strand
120: terminal
123: connecting portion
124 laminate portion
125: auxiliary crimping portion
126: easily breakable portion
127: locked portion
129: tapered surface
132: extending portion
133: wire barrel portion
135: locking portion
136: low compression portion
137: high compression portion

The invention claimed is:

1. A terminal-provided wire, comprising:

a wire with a core whose end is exposed; and a terminal crimped to the end of the core and connectable to a mating side;

wherein the terminal includes:

a rear terminal portion with a bottom plate portion on which the core is to be placed, a pair of wire barrel portions respectively laterally extending from opposite ends of the bottom plate portion and to be crimped to wind around the core on the bottom plate portion, an easily breakable portion extending in an axial direction from the bottom plate portion and to be broken at the time of disassembling, and a first fixing portion extending in the axial direction from the easily breakable portion; and a front terminal portion formed separately from the rear terminal portion and having an auxiliary crimping portion to be placed on and overlapped with the bottom plate portion in such a manner as to be sandwiched between the bottom plate portion and the core and to be crimped to the core together with the wire barrel portions to partly highly compress the core, a second fixing portion to be fixed to the first fixing portion in such a manner as to be placed on and overlapped with the first fixing portion, and a connecting portion extending in the axial direction from the second fixing portion and to be connected to the mating side.

2. A terminal-provided wire according to claim 1, wherein the easily breakable portion is so broken that the bottom plate portion and the first fixing portion are separated from each other when the wire is pulled in a state where the connecting portion is connected to the mating side at the time of disassembling.

3. A terminal-provided wire according to claim 1, wherein the easily breakable portion includes a hole portion or a cutout portion.

4. A terminal-provided wire according to claim 1, wherein the front terminal portion includes a junction portion configured to join the auxiliary crimping portion and the second fixing portion and to be laid on the easily breakable portion.

5. A terminal-provided wire according to claim 1, wherein the auxiliary crimping portion is shaped along a circumferential direction of the core and grips a part of the core when being crimped to the core together with the wire barrel portions.

6. A terminal-provided wire according to claim 1, wherein the second fixing portion of the front terminal is so fixed to the first fixing portion of the rear terminal that the auxiliary crimping portion and the easily breakable portion are close to each other.

7. A terminal-provided wire according to claim 1, wherein the terminal is a ground terminal.

8. A terminal-provided wire according to claim 1, wherein the core includes a low compression portion crimped only by the wire barrel portion and a high compression portion more compressed than the low compression portion by being crimped by both the wire barrel portion and the auxiliary crimping portion.

9. A terminal-provided wire according to claim 8, wherein:

the core includes a plurality of strands made of metal; and a compression rate of the low compression portion is set to be higher than 50% and that of the high compression portion is set to be lower than 50% when the compression rate is defined to be (cross-sectional area of the core after compression)/(cross-sectional area of the core before compression)×100(%).

10. A terminal-provided wire according to claim 9, wherein the compression rate of the high compression portion is set to be not higher than 35%.

11. A terminal-provided wire according to claim 10, wherein the compression rate of the high compression portion is set to be not higher than 25%.

12. A terminal-provided wire according to claim 11, wherein the compression rate of the high compression portion is set to be not higher than 20%.

13. A terminal-provided wire, comprising:

a wire with a core; and a terminal connected to the core exposed from an end of the wire;

wherein the terminal includes:

a wire barrel portion to be crimped to the core, an extending portion formed integrally with the wire barrel portion and extending from the wire barrel portion;

a laminate portion as a member separate from the extending portion laid on and overlapping with the extending portion;

an auxiliary crimping portion extending integrally from the laminate portion toward the wire barrel portion and overlapped with the barrel portion to be crimped to the core in a state sandwiched between the wire barrel portion and the core;

a connecting portion extending from the laminate portion in a direction different from the auxiliary crimping portion and to be connected to a mating member;

a locking portion integral with the extending portion and configured to lock the extending portion to the laminate portion and to release the extending portion and the laminate portion from a locked state when a force is applied to the wire; and an easily breakable portion formed between a locked portion locked by the locking portion out of the laminate portion and the auxiliary crimping portion and easily breakable when a force is applied to the wire.

14. A terminal-provided wire according to claim 13, wherein the easily breakable portion is formed into a groove.

15. A terminal-provided wire according to claim 13, wherein the locking portion is formed into claws extending toward opposite lateral sides from the tip of the extending portion.

16. A terminal-provided wire according to claim 13, wherein the locked portion is formed with a tapered surface for opening and deforming the locking portion by coming into contact with the locking portion.

17. A terminal crimped to an end of a core of a wire including the core whose end is exposed, and connectable to a mating side, comprising:

a rear terminal portion including a bottom plate portion on which the core is to be placed, a pair of wire barrel portions respectively laterally extending from opposite ends of the bottom plate portion and to be crimped to wind around the core on the bottom plate portion, an easily breakable portion extending in an axial direction from the bottom plate portion and to be broken at the time of disassembling, and a first fixing portion extending in the direction from the easily breakable portion; and a front terminal portion formed separately from the rear terminal portion and including an auxiliary crimping portion to be placed on and overlapped with the bottom plate portion in such a manner as to be sandwiched between the bottom plate portion and the core and to be crimped to the core together with the wire barrel portions to partly highly compress the core, a second fixing portion to be fixed to the first fixing portion in such a manner as to be placed on and overlapped with the first fixing portion, and a connecting portion extending in the axial direction from the second fixing portion and to be connected to the mating side.

18. A terminal, comprising:

a wire barrel portion to be crimped to a core exposed from an end of a wire including the core;

an extending portion formed integrally with the wire barrel portion and extending from the wire barrel portion;

a laminate portion laid on and overlapping with the extending portion;

an auxiliary crimping portion extending integrally from the laminate portion toward the wire barrel portion and overlapped with the barrel portion to be crimped to the core in a state sandwiched between the wire barrel portion and the core;

a connecting portion extending from the laminate portion in a direction different from the auxiliary crimping portion and to be connected to a mating member;

a locking portion integral with the extending portion and configured to lock the extending portion to the laminate portion and to release the extending portion and the laminate portion from a locked state when a force is applied to the wire; and an easily breakable portion formed between a locked portion locked by the locking portion out of the laminate portion and the auxiliary crimping portion and easily breakable when a force is applied to the wire.

19. A terminal according to claim 18, wherein the auxiliary crimping portion is laid on a part of the wire barrel portion.

20. A terminal according to claim 18, wherein the easily breakable portion is formed into a groove.

21. A terminal according to claim 18 wherein the locking portion is a pair of locking claws extending toward opposite lateral sides from the tip of the extending portion.

22. A terminal according to claim 18, wherein the locked portion is formed with a tapered surface for opening and deforming the locking portion by coming into contact with the locking portion.

* * * * *